US010670998B1

(12) United States Patent
Ota et al.

(10) Patent No.: US 10,670,998 B1
(45) Date of Patent: Jun. 2, 2020

(54) IMAGE FORMING APPARATUS INCLUDING AN ELECTROSTATIC IMAGE DEVELOPER INCLUDING A TONER

(71) Applicant: FUJI XEROX CO., LTD., Tokyo (JP)

(72) Inventors: Naoki Ota, Kanagawa (JP); Teppei Yawada, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/541,813

(22) Filed: Aug. 15, 2019

(30) Foreign Application Priority Data

Mar. 22, 2019 (JP) ..... 2019-054859

(51) Int. Cl.
*G03G 15/16* (2006.01)
*G03G 9/087* (2006.01)

(52) U.S. Cl.
CPC ..... *G03G 15/1675* (2013.01); *G03G 9/08797* (2013.01); *G03G 15/1605* (2013.01)

(58) Field of Classification Search
CPC ..... G03G 15/1675
(Continued)

(56) References Cited

U.S. PATENT DOCUMENTS 5,249,024 A * 9/1993 Menjo ..... G03G 15/0105 347/102
6,040,104 A 3/2000 Nakamura et al.
(Continued)

FOREIGN PATENT DOCUMENTS

JP 11-194542 A 7/1999
JP 2012-42827 A 3/2012
JP 2018-45218 A 3/2018

*Primary Examiner* — Quana Grainger
(74) *Attorney, Agent, or Firm* — Sughrue Mion, PLLC

(57) ABSTRACT

An image forming apparatus includes: an image holding member; a charging unit that charges a surface of the image holding member; an electrostatic image forming unit that forms an electrostatic image on the charged surface of the image holding member; a developing unit that houses an electrostatic image developer including a toner containing an external additive and develops the electrostatic image formed on the surface of the image holding member with the electrostatic image developer to thereby form a toner image; a transfer unit that transfers the toner image formed on the surface of the image holding member onto a surface of a recording medium directly or through an intermediate transfer body; and a fixing unit that fixes the toner image transferred onto the surface of the recording medium. The transfer unit includes a contact portion-forming member that comes into contact with the image holding member or the intermediate transfer body to form a contact portion and a transfer bias application unit that applies a transfer bias including a superimposed voltage to the contact portion. The superimposed voltage has two peak values and is composed of an AC voltage and a DC voltage. The AC voltage has a duty ratio D of less than 50% on a peak value side opposite to a peak value that causes the toner in the contact portion to move from the image holding member or the intermediate transfer body toward the contact portion-forming member. The DC voltage causes the electric potential of the contact portion-forming member to be shifted to the side opposite to the charge polarity of the toner such that the absolute value of the electric potential of the contact portion-forming member is larger than the absolute value of the electric potential of the image holding member or the intermediate transfer body. The toner satisfies the following formulas:

$$(\ln \eta(T1)-\ln \eta(T2))/(T1-T2)\leq -0.14;$$

$$(\ln \eta(T2)-\ln \eta(T3))/(T2-T3)\geq -0.15; \text{ and}$$

$$(\ln \eta(T1)-\ln \eta(T2))/(T1-T2)<(\ln \eta(T2)-\ln \eta(T3))/(T2-T3),$$

(Continued)

where $\eta(T1)$ is the viscosity of the toner at 60° C., $\eta(T2)$ is the viscosity of the toner at 90° C., and $\eta(T3)$ is the viscosity of the toner at 130° C.

14 Claims, 4 Drawing Sheets

(58) Field of Classification Search
USPC ..... 399/66
See application file for complete search history.

(56) References Cited

U.S. PATENT DOCUMENTS

| | | | |
|---|---|---|---|
| 8,781,348 | B2 | 7/2014 | Ogino et al. |
| 10,185,255 | B2 | 1/2019 | Kochi et al. |

* cited by examiner

IMAGE FORMING APPARATUS INCLUDING AN ELECTROSTATIC IMAGE DEVELOPER INCLUDING A TONER

CROSS-REFERENCE TO RELATED APPLICATIONS

This application is based on and claims priority under 35 USC 119 from Japanese Patent Application No. 2019-054859 filed Mar. 22, 2019.

BACKGROUND

(i) Technical Field

The present disclosure relates to an image forming apparatus.

(ii) Related Art

Visualization methods, such as an electrophotographic method, which visualize image information through electrostatic images are currently used in various fields.

In a conventional electrophotographic method commonly used, image information is visualized through the steps of: forming electrostatic latent images on photoconductors or electrostatic recording materials using various means; causing electroscopic particles referred to as toner to adhere to the electrostatic latent images to develop the electrostatic latent images (toner images); transferring the developed images onto the surface of a transfer body; and fixing the images by, for example, heating.

Japanese Laid Open Patent Application Publication No. 2012-042827 discloses an image forming apparatus that uses as transfer means a transfer device including: an image carrier that supports a toner image; a nip-forming member that abuts against the front surface of the image carrier and forms a transfer nip together with the image carrier; and transfer bias application means for applying a transfer bias to thereby transfer the toner image on the image carrier onto a recording material at the position of the transfer nip. The transfer bias is a superimposed bias including a direct current component and an alternating current component superimposed on the direct current component, and the direct current component is applied between the image carrier and the nip-forming member and causes the electric potential of the nip-forming member to be shifted to the side opposite to the charge polarity of the toner such that that the absolute value of the electric potential of the nip-forming member is larger than the absolute value of the electric potential of the image carrier. The transfer device further includes type information acquisition means for acquiring information about the type of the recording material. The transfer bias has a positive peak value and a negative peak value, and one of the positive and negative peak values is a returning peak value used to generate an electric field that causes the toner moved from the image carrier to the recording material within the transfer nip to return from the recording material to the image carrier. The transfer bias application means is configured to perform a process for changing the return peak value according to the type information acquired by the type information acquisition means.

Japanese Laid Open Patent Application Publication No. 2018-045218 discloses an image forming apparatus in which a toner image on a surface of an image carrier is transferred onto a recording sheet in a transfer nip at which the image carrier and a nip-forming member abut against each other while a transfer bias that is a superimposed voltage composed of a DC voltage and an AC voltage superimposed on the DC voltage is outputted from a transfer power source to cause a transfer current to flow through the transfer nip. In this image forming apparatus, the micro-rubber hardness of the image carrier is less than 100. The transfer bias has two peak values, and an opposite peak duty that is a peak duty on the side opposite to a transfer peak value for strongly moving toner electrostatically from the image carrier side to the nip-forming member side within the transfer nip is less than 50[%].

Japanese Laid Open Patent Application Publication No. 11-194542 discloses a toner for electrophotography containing a binder resin and a coloring agent. The binder resin used is a resin in which a minimum value of tan δ of the binding resin is present between its glass transition temperature (Tg) and the temperature at which the loss modulus (G") is $1\times10^4$ Pa, and the minimum value of tan δ is less than 1.2. The storage modulus (G') at the temperature at which tan δ is minimum is $5\times10^5$ Pa or more, and the value of tan δ at the temperature at which $G''=1\times10^4$ Pa is 3.0 or more.

SUMMARY

When an image is formed on a recording medium with surface irregularities, a gradation pattern corresponding to the surface irregularities may be formed. In particular, when an image is formed in a high-temperature environment, in a low-temperature environment, at a low area coverage, etc., the gradation pattern is more likely to be formed.

It is therefore desired that, even when an image is formed on a recording medium with surface irregularities in a high-temperature environment, in a low-temperature environment, or at a low area coverage, the occurrence of a gradation pattern corresponding to the surface irregularities of the recording medium be prevented. In particular, it is strongly desired that, even when a low-area coverage image is formed in a high-temperature environment, the occurrence of a gradation pattern corresponding to the surface irregularities of the recording medium be prevented.

Aspects of non-limiting embodiments of the present disclosure relate to an image forming apparatus with which, even when a low-area coverage image is formed on a recording medium with surface irregularities in a high-temperature environment, the occurrence of a gradation pattern corresponding to the surface irregularities of the recording medium is more effectively prevented than with an image forming apparatus including a developing unit that houses an electrostatic image developer containing a toner in which $(\ln \eta(T1)-\ln \eta(T2))/(T1-T2)$ is more than −14, a toner in which $(\ln \eta(T2)-\ln \eta(T3))/(T2-T3)$ is less than −0.15, or a toner in which the value of $(\ln \eta(T1)-\ln \eta(T2))/(T1-T2)$ is equal to or more than the value of $(\ln \eta(T2)-\ln \eta(T3))/(T2-T3)$, where $\eta(T1)$ is the viscosity η of the toner at T1=60° C., $\eta(T2)$ is the viscosity η of the toner at T2=90° C., and $\eta(T3)$ is the viscosity η of the toner at T3=130° C.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including:

an image holding member;

a charging unit that charges a surface of the image holding member;

an electrostatic image forming unit that forms an electrostatic image on the charged surface of the image holding member;

a developing unit that houses an electrostatic image developer including a toner containing an external additive and develops the electrostatic image formed on the surface of the image holding member with the electrostatic image developer to thereby form a toner image;

a transfer unit that transfers the toner image formed on the surface of the image holding member onto a surface of a recording medium directly or through an intermediate transfer body; and a fixing unit that fixes the toner image transferred onto the surface of the recording medium, wherein the transfer unit includes a contact portion-forming member that contacts with the image holding member or the intermediate transfer body to form a contact portion and a transfer bias application unit that applies a transfer bias including a superimposed voltage to the contact portion, wherein the superimposed voltage has two peak values and is composed of an AC voltage and a DC voltage, the AC voltage having a duty ratio D of less than 50% on a peak value side opposite to a peak value that causes the toner in the contact portion to move from the image holding member or the intermediate transfer body toward the contact portion-forming member, the DC voltage causing the electric potential of the contact portion-forming member to be shifted to a side opposite to the charge polarity of the toner such that the absolute value of the electric potential of the contact portion-forming member is larger than the absolute value of the electric potential of the image holding member or the intermediate transfer body, and wherein the toner satisfies the following formulas:

$$(\ln \eta(T1)-\ln \eta(T2))/(T1-T2)\leq -0.14;$$

$$(\ln \eta(T2)-\ln \eta(T3))/(T2-T3)\geq -0.15; \text{ and}$$

$$(\ln \eta(T1)-\ln \eta(T2))/(T1-T2)<(\ln \eta(T2)-\ln \eta(T3))/(T2-T3),$$

where $\eta(T1)$ is the viscosity of the toner at 60° C., $\eta(T2)$ is the viscosity of the toner at 90° C., and $\eta(T3)$ is the viscosity of the toner at 130° C.

BRIEF DESCRIPTION OF THE DRAWINGS

Exemplary embodiment of the present disclosure will be described in detail based on the following figures, wherein.

DETAILED DESCRIPTION

Figure 1:
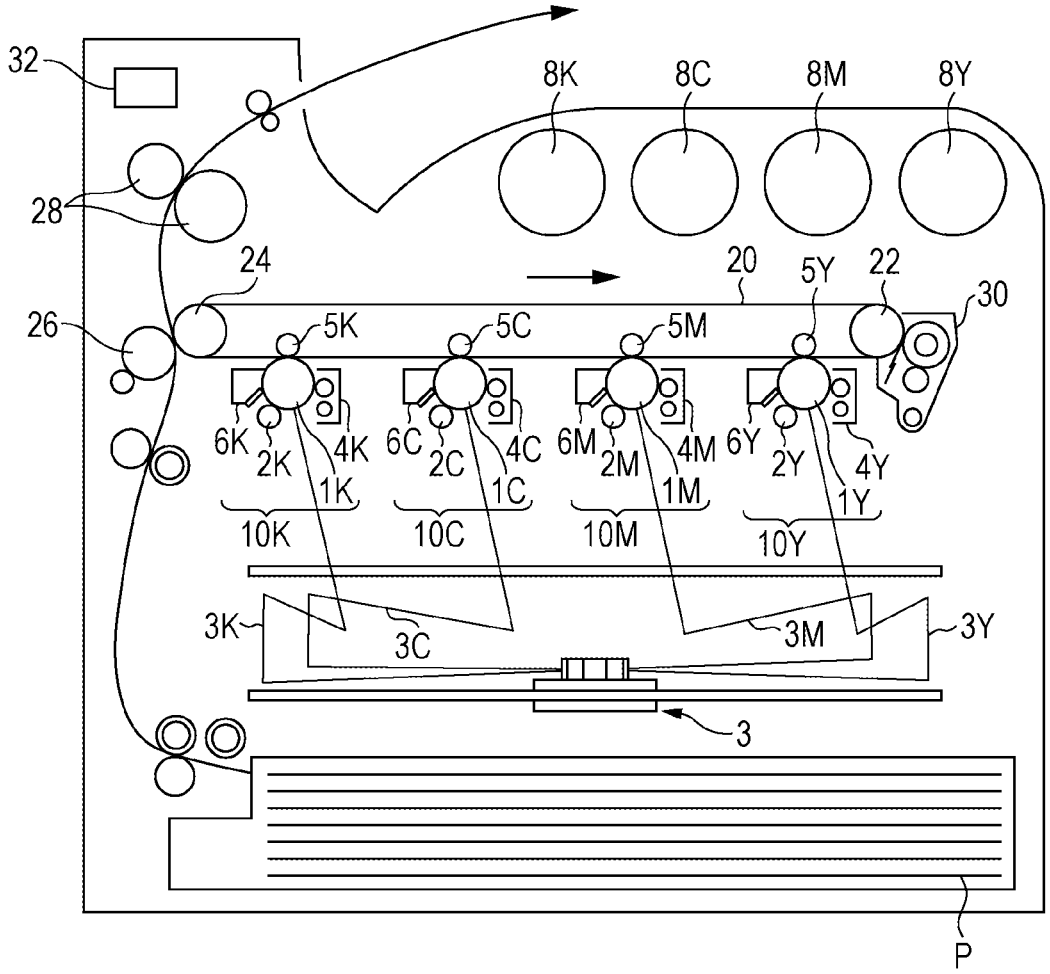
FIG. 1 is a schematic configuration diagram showing an example of an image forming apparatus according to an exemplary embodiment.

In an exemplary embodiment of the disclosure, when reference is made to the amount of a component in a composition, if the composition contains a plurality of materials corresponding to the above component, the above amount means the total amount of the plurality of materials, unless otherwise specified.

In the exemplary embodiment of the disclosure, an "electrostatic image developer" may be referred to simply as a "developer."

The exemplary embodiment of the present disclosure will be described.

<Image Forming Apparatus>

An image forming apparatus according to an exemplary embodiment includes: an image holding member; a charging unit that charges a surface of the image holding member; an electrostatic image forming unit that forms an electrostatic image on the charged surface of the image holding member; a developing unit that houses an electrostatic image developer including a toner containing an external additive and develops the electrostatic image formed on the surface of the image holding member with the electrostatic image developer to thereby form a toner image; a transfer unit that transfers the toner image formed on the surface of the image holding member onto a surface of a recording medium directly or through an intermediate transfer body; and a fixing unit that fixes the toner image transferred onto the surface of the recording medium.

The transfer unit of the image forming apparatus according to the present exemplary embodiment includes a contact portion-forming member that contacts with the image holding member or the intermediate transfer body to form a contact portion and a transfer bias application unit that applies a transfer bias including a superimposed voltage to the contact portion. The superimposed voltage of the transfer bias has two peak values and is composed of an AC voltage and a DC voltage. The AC voltage has a duty ratio D of less than 50% on a peak value side opposite to a peak value that causes the toner in the contact portion to move from the image holding member or the intermediate transfer body toward the contact portion-forming member. The DC voltage causes the electric potential of the contact portion-forming member to be shifted to a side opposite to the charge polarity of the toner such that the absolute value of the electric potential of the contact portion-forming member is larger than the absolute value of the electric potential of the image holding member or the intermediate transfer body.

The developing unit of the image forming apparatus according to the present exemplary embodiment houses an electrostatic image developer including a toner which contains an external additive, in which $(\ln \eta(T1)-\ln \eta(T2))/(T1-T2)$ is −0.14 or less, in which $(\ln \eta(T2)-\ln \eta(T3))/(T2-T3)$ is −0.15 or more, and in which $(\ln \eta(T2)-\ln \eta(T3))/(T2-T3)$ is larger than $(\ln \eta(T1)-\ln \eta(T2))/(T1-T2)$, where $\eta(T1)$ is the viscosity $\eta$ of the toner at T1=60° C., $\eta(T2)$ is the viscosity $\eta$ of the toner at T2=90° C., and $\eta(T3)$ is the viscosity $\eta$ of the toner at T3=130° C.

The transfer unit used for transfer with the transfer bias is referred to also as a "specific transfer unit." The toner containing the external additive and having the above characteristics is referred to also as a "specific toner."

With the image forming apparatus according to the present exemplary embodiment, even when an image is formed on a recording medium with surface irregularities in a high-temperature environment, in a low-temperature environment, or at a low area coverage, the occurrence of a gradation pattern corresponding to the surface irregularities of the recording medium is prevented. In particular, even when a low-area coverage image is formed in a high-temperature environment, the occurrence of a gradation pattern corresponding to the surface irregularities of the recording medium is prevented.

The reason for this may be as follows.

First, the characteristics of the specific toner will be described. The above formula $(\ln \eta(T1)-\ln \eta(T2))/(T1-T2)$ is an indicator of the degree of change in the viscosity of the toner in the temperature range of 60° C. to 90° C. An indicator value of −0.14 or less means that the change in the viscosity of the toner in the range of 60° C. to 90° C. is large. The formula $(\ln \eta(T2)-\ln \eta(T3))/(T2-T3)$ is an indicator of the degree of change in the viscosity of the toner in the temperature range of 90° C. to 120° C. When this value is −0.15 or more and the value of $(\ln \eta(T2)-\ln \eta(T3))/(T2-T3)$ is larger than the value of $(\ln \eta(T1)-\ln \eta(T2))/(T1-T2)$, the degree of change in the viscosity of the toner in the range of 90° C. to 120° C. is small. Specifically, in the specific toner, the change in viscosity in the temperature range of 60° C. to 90° C. is steep, and the change in viscosity in the temperature range of 90° C. to 120° C. is small.

In the specific toner having the above-described viscosity change characteristics, it is considered that the binder resin contained in the toner contains a low molecular weight component and a high molecular weight component at an appropriate ratio. This may be because of the following reason. When the binder resin contains the low molecular weight component, the viscosity in the range of 60° C. to 90° C. tends to change easily. When the binder resin contains the high molecular weight component, the viscosity in the high temperature range of 90° C. to 120° C. tends not to change easily.

In the specific toner having the above-described viscosity change characteristics, the change in viscosity in the temperature range of from room temperature (e.g., 20° C.) to 60° C. is small, and the specific toner may have appropriate viscoelasticity. Specifically, in the specific toner, the binder resin contains the low molecular weight component and the high molecular weight component at an appropriate ratio. The viscosity of the binder resin is unlikely to change at a temperature of 60° C. or lower, and its viscoelasticity is maintained in an appropriate range.

In recent image forming apparatuses, various recording mediums are used, and there is a need for a technique capable of achieving high transfer efficiency irrespective of the type of recording medium. For example, in one known technique described in Japanese Laid Open Patent Application Publication Nos. 2012-042827 and 2018-045218, a transfer bias including a DC component and an AC component superimposed thereon is used for a recording medium with surface irregularities, and the toner is thereby transferred deep into recessed portions of the recording medium with surface irregularities.

However, the use of only the above-described transfer bias may cause a gradation pattern corresponding to the surface irregularities of the recording medium depending on the environment during image formation such as a high-temperature environment or a low-temperature environment or the conditions during image formation such as a low area coverage.

Specifically, when an image is formed in a high-temperature environment (for example, at 30° C. or at 30° C. and 90% RH in a high-temperature high-humidity environment), if a toner with low viscoelasticity (a soft toner) is used, the toner is softened in the developing device, and therefore the external additive tends to be embedded in the toner particles. When a low-area coverage image is formed, the residence time of the toner in the developing device is long, and a high load tends to be applied to the toner, so that the external additive tends to be embedded in the toner particles.

When an image is formed in a low-temperature environment (for example, at 10° C. or at 10° C. and 15% RH in a low-temperature low-humidity environment), a high-viscoelasticity toner (a hard toner) becomes harder in, for example, the developing device, and the external additive tends to be separated from the toner particles.

When the external additive is embedded in the toner particles or separated from the toner particles as described above, the non-electrostatic adhesion of the toner to the image holding member or the intermediate transfer body increases. In this case, the use of only the above-described transfer bias cannot effectively prevent the occurrence of a gradation pattern corresponding to the surface irregularities of the recording medium.

More specifically, when the above-described transfer bias is used, the toner moves electrostatically and vibrates between the recording medium and the image holding member or the intermediate transfer body due to the influence of the AC component. The vibration of the toner tends to facilitate embedment of the external additive in the toner particles or separation of the external additive from the toner particles. This may also facilitate the occurrence of a gradation pattern corresponding to the surface irregularities of the recording medium.

The image forming apparatus according to the present exemplary embodiment includes the specific transfer unit that uses the transfer bias including the DC component and the AC component superimposed thereon and the developing unit that houses the developer containing the above-described specific toner (i.e., the toner having appropriate viscoelasticity).

Therefore, even when an image is formed in a high-temperature environment or a low-temperature environment or at a low area coverage, particularly when a low-area coverage image is formed in a high-temperature environment, embedment of the external additive in the toner particles or separation of the external additive from the toner particles is unlikely to occur. In the specific transfer unit, the toner is transferred even into the recessed portions of the surface irregularities. This may prevent the occurrence of a gradation pattern corresponding to the surface irregularities of the recording medium.

With the specific toner having the above-described viscosity change characteristics, the viscosity of the surface of the toner on a fixing member side in a fixing unit is high. In this case, the toner image is easily separated from the fixing member. Moreover, the toner interface on the recording medium side easily melts, so that the toner may easily penetrate into the recording medium sufficiently.

Therefore, in the image forming apparatus according to the present exemplary embodiment, a gradation pattern corresponding to the surface irregularities of the recording medium may be unlikely to occur.

The specific transfer unit of the image forming apparatus according to the present exemplary embodiment may be a so-called direct transfer-type transfer unit that transfers a toner image formed on the surface of the image holding member directly onto the surface of a recording medium or may be a so-called intermediate transfer-type transfer unit in which a toner image formed on the surface of the image holding member is first-transferred onto the surface of an intermediate transfer body and then the toner image transferred onto the surface of the intermediate transfer body is second-transferred onto the surface of a recording medium.

From the viewpoint of effectively preventing the occurrence of a gradation pattern corresponding to the surface irregularities of a recording medium, the specific transfer unit used may be the intermediate transfer-type transfer unit in which a toner image formed on the surface of the image holding member is transferred onto the surface of a recording medium through an intermediate transfer body.

The image forming apparatus according to the present exemplary embodiment may be any of various well-known image forming apparatuses such as: an apparatus including a cleaning unit that cleans an uncharged surface of the image holding member after transfer of a toner image; an apparatus including a charge eliminating unit that eliminates charges by irradiating the surface of the image holding member with charge elimination light after transfer of the toner image but before charging; and an apparatus including an image holding member-heating member for heating the image holding member to reduce relative temperature.

An example of the image forming apparatus in the present exemplary embodiment will be described with reference to the drawings, but the example is not a limitation. In the following description, major components shown in FIG. 1 will be described, and description of other components will be omitted.

FIG. 1 is a schematic configuration diagram showing the image forming apparatus according to the present exemplary embodiment.

The image forming apparatus shown in FIG. 1 includes first to fourth electrophotographic image forming units 10Y, 10M, 10C, and 10K that output yellow (Y), magenta (M), cyan (C), and black (K) images, respectively, based on color-separated image data. These image forming units (hereinafter may be referred to simply as "units") 10Y, 10M, 10C, and 10K are arranged so as to be spaced apart from each other horizontally by a prescribed distance. These units 10Y, 10M, 10C, and 10K may each be a process cartridge detachable from the image forming apparatus.

An intermediate transfer belt (an example of the intermediate transfer body) 20 is disposed above the units 10Y, 10M, 10C, and 10K so as to extend through these units. The intermediate transfer belt 20 is wound around a driving roller 22 and a support roller 24 that are in contact with the inner surface of the intermediate transfer belt 20 and runs in a direction from the first unit 10Y toward the fourth unit 10K. A force is applied to the support roller 24 by, for example, an unillustrated spring in a direction away from the driving roller 22, so that a tension is applied to the intermediate transfer belt 20 wound around the rollers. An intermediate transfer belt cleaner 30 is disposed on the image holding side of the intermediate transfer belt 20 so as to be opposed to the driving roller 22. A second transfer roller (an example of a second transfer unit) 26 is disposed on the image holding side of the intermediate transfer belt 20 so as to be opposed to the support roller 24. A bias power source (not shown) used to apply a second transfer bias is connected to the support roller 24.

In the image forming apparatus shown in FIG. 1, the second transfer roller 26 corresponds to an example of the contact portion-forming member of the specific transfer unit, and the bias power source connected to the support roller 24 corresponds to an example of the transfer bias application unit. The bias power source connected to the support roller 24 supplies a transfer bias (i.e., the second transfer bias described later) to the specific transfer unit to generate a transfer electric field in a contact portion between the second transfer roller 26 and the intermediate transfer belt 20.

Developers containing toners are housed in developing devices (examples of the developing unit) 4Y, 4M, 4C, and 4K of the units 10Y, 10M, 10C, and 10K. Yellow, magenta, cyan, and black toners contained in toner cartridges 8Y, 8M, 8C, and 8K, respectively, are supplied to the respective developing devices 4Y, 4M, 4C, and 4K.

In the image forming apparatus according to the present exemplary embodiment, at least one of the toners contained in the developing devices 4Y, 4M, 4C, and 4K is a specific toner. From the viewpoint of more effectively preventing the occurrence of a gradation pattern corresponding to surface irregularities of a recording medium, all the toners may be specific toners.

The specific toners and the developing units that house the developers containing the specific toners will be described later. The charge polarity of each toner is negative (−).

The first to fourth units 10Y, 10M, 10C, and 10K have the same structure and operate similarly. Therefore, the first unit 10Y that is disposed upstream in the running direction of the intermediate transfer belt and forms a yellow image will be described as a representative unit.

The first unit 10Y includes a photoconductor 1Y, which is an example of the image holding member.

A charging roller (an example of the charging unit) 2Y, an exposure unit (an example of the electrostatic image forming unit) 3, a developing device (an example of the developing unit) 4Y, a first transfer roller 5Y, and a photoconductor cleaner (an example of the image holding member cleaning unit) 6Y are disposed around the photoconductor 1Y in this order. The charging roller 2Y charges the surface of the photoconductor 1Y to a prescribed electric potential, and the exposure unit 3 exposes the charged surface to a laser beam 3Y according to a color-separated image signal to thereby form an electrostatic image. The developing device 4Y supplies a charged toner to the electrostatic image to develop the electrostatic image, and the first transfer roller 5Y transfers the developed toner image onto the intermediate transfer belt 20. The photoconductor cleaner 6Y removes the toner remaining on the surface of the photoconductor 1Y after the first transfer.

The first transfer roller 5Y is disposed on the inner side of the intermediate transfer belt 20 and placed at a position opposed to the photoconductor 1Y.

Bias power sources (not shown) for applying first transfer biases are connected to the respective first transfer rollers 5Y, 5M, 5C, and 5K of the units. The bias power sources are controlled by a controller 32 to change the values of transfer biases applied to the respective first transfer rollers.

A yellow image formation operation in the first unit 10Y will be described.

First, before the operation, the surface of the photoconductor 1Y is charged by the charging roller 2Y to an electric potential of −600 V to −800 V.

The photoconductor 1Y is formed by stacking at least a photosensitive layer on a conductive substrate (with a volume resistivity of, for example, $1\times10^{-6}$ Ωcm or less at 20° C.). The photosensitive layer normally has a high resistance (the resistance of a general resin) but has the property that, when irradiated with a laser beam, the specific resistance of a portion irradiated with the laser beam is changed. Therefore, the charged surface of the photoconductor 1Y is irradiated with a laser beam 3Y from the exposure unit 3 according to yellow image data sent from the controller 32. An electrostatic image with a yellow image pattern is thereby formed on the surface of the photoconductor 1Y.

The electrostatic image is an image formed on the surface of the photoconductor 1Y by charging and is a negative latent image formed as follows. The specific resistance of the irradiated portions of the photosensitive layer irradiated with the laser beam 3Y decreases, and this causes charges on the surface of the photoconductor 1Y to flow. However, the charges in portions not irradiated with the laser beam 3Y remain present, and the electrostatic image is thereby formed.

The electrostatic image formed on the photoconductor 1Y rotates to a prescribed developing position as the photoconductor 1Y rotates. Then the electrostatic image on the photoconductor 1Y at the developing position is developed and visualized as a toner image by the developing device 4Y.

An electrostatic image developer containing, for example, at least a yellow toner and a carrier is housed in the developing device 4Y. The yellow toner is agitated in the developing device 4Y and thereby frictionally charged. The charged yellow toner has a charge with the same polarity (negative polarity) as the charge on the photoconductor 1Y and is held on a developer roller. As the surface of the photoconductor 1Y passes through the developing device 4Y, the yellow toner electrostatically adheres to charge-erased latent image portions on the surface of the photoconductor 1Y, and the latent image is thereby developed with the yellow toner. Then the photoconductor 1Y with the yellow toner image formed thereon continues running at a prescribed speed, and the toner image developed on the photoconductor 1Y is transported to a prescribed first transfer position.

When the yellow toner image on the photoconductor 1Y is transported to the first transfer position, a first transfer bias is applied to the first transfer roller 5Y, and an electrostatic force directed from the photoconductor 1Y toward the first transfer roller 5Y acts on the toner image, so that the toner image on the photoconductor 1Y is transferred onto the intermediate transfer belt 20. The transfer bias (i.e., the first transfer bias) applied in this case has a (+) polarity opposite to the (−) charge polarity of the toner and is controlled to, for example, +10 μA in the first unit 10Y by the controller 32. The toner remaining on the photoconductor 1Y is removed and collected by the photoconductor cleaner 6Y.

The first transfer biases applied to first transfer rollers 5M, 5C, and 5K of the second unit 10M and subsequent units are controlled in the same manner as in the first unit.

The intermediate transfer belt 20 with the yellow toner image transferred thereon in the first unit 10Y is sequentially transported through the second to fourth units 10M, 10C and 10K, and toner images of respective colors are superimposed and multi-transferred.

Then the intermediate transfer belt 20 with the four color toner images multi-transferred thereon in the first to fourth units reaches a second transfer portion that is composed of the intermediate transfer belt 20, the support roller 24 in contact with the inner surface of the intermediate transfer belt, and the second transfer roller (an example of the second transferring unit) 26 disposed on the image holding surface side of the intermediate transfer belt 20.

A recording paper sheet (an example of the recording medium) P is supplied to a gap (contact portion) between the second transfer roller 26 and the intermediate transfer belt 20 in contact with each other at a prescribed timing through a supply mechanism, and a second transfer bias is applied to the support roller 24.

The second transfer roller 26 is grounded, and a bias power source (not shown) for applying the second transfer bias is connected to the support roller 24. The bias power source includes a DC power source and an AC power source and is controlled by the controller 32 to output, as the second transfer bias, a superimposed voltage composed of a DC voltage and an AC voltage superimposed thereon, as described later.

The second transfer bias applied to the support roller 24 causes an electrostatic force directed from the intermediate transfer belt 20 toward the recording paper sheet P to act on the toner image, so that the toner image on the intermediate transfer belt 20 is transferred onto the recording paper sheet P.

The second transfer bias applied to the support roller 24 will be described later in detail in the section of the specific transfer unit.

The recording paper sheet P with the toner image transferred thereon is transported to a press contact portion (nip portion) of a pair of fixing rollers in a fixing device (an example of the fixing unit) 28, and the toner image is fixed onto the recording paper sheet P to thereby form a fixed image. The recording paper sheet P with the color image fixed thereon is transported to an ejection portion, and a series of the color image formation operations is thereby completed.

The controller 32 of the image forming apparatus shown in FIG. 1 is configured to control the operations of the components of the image forming apparatus.

Specifically, the controller 32 is configured as a computer for controlling the entire apparatus and executing various computations and includes, for example, a CPU (Central Processing Unit), various memories [such as a RAM (Random Access Memory), a ROM (Read Only Memory), and a non-volatile memory], and an input/output (I/O) interface that are connected through buses.

For example, the CPU executes programs stored in the memories (such as programs for changing the second transfer bias according to the type of recording medium, e.g., a program for controlling the second transfer bias according to the type of recording medium and a program for changing the second transfer bias according to the type of recording medium) to control the operations of the components of the image forming apparatus. The storage mediums for storing the programs executed by the CPU are not limited to the memories. For example, the storage mediums may be flexible disks, DVD disks, magneto-optical disks, and USB memories (Universal Serial Bus memories) and may be storage units of other devices connected through communication devices (not shown).

[Developing Units]

The developing units in the image forming apparatus according to the present exemplary embodiment house the respective specific toners containing external additives.

Specifically, each developing unit may be a commonly used developing device in which an image is developed with the developer in contact with the image holding member or without contact with the image holding member.

No particular limitation is imposed on the developing device so long as it has the above-described function, and a suitable developing device may be selected according to the intended purpose. Examples of the developing device include a well-known developing device that has the function of causing a one-component or two-component developer to adhere to a photoconductor using a brush or a roller. In particular, a developing device that uses a developing roller with a developer held on its surface may be used.

[Developers]

Each developer housed in a corresponding developing unit contains at least a specific toner. The developer may be a one-component developer containing only the specific toner or may be a two-component developer containing the specific toner and a carrier.

(Specific Toner)

The specific toner contains toner particles and an external additive.

(Characteristic Viscosity Values)

In the specific toner:

$(\ln \eta(T1)-\ln \eta(T2))/(T1-T2)$ is −0.14 or less;

$(\ln \eta(T2)-\ln \eta(T3))/(T2-T3)$ is −0.15 or more; and $(\ln \eta(T2)-\ln \eta(T3))/(T2-T3)$ is larger than $(\ln \eta(T1)-\ln \eta(T2))/(T1-T2)$, where $\eta(T1)$ is the viscosity $\eta$ of the toner at $T1=60°$ C., $\eta(T2)$ is the viscosity $\eta$ of the toner at $T2=90°$ C., and $\eta(T3)$ is the viscosity $\eta$ of the toner at $T3=130°$ C.

In the present disclosure, "ln η(T1)" is the natural logarithm of the viscosity η of the toner at T1=60° C.

In the present disclosure, the unit of the viscosity of the toner is Pa·s, unless otherwise specified.

In the present exemplary embodiment, the viscosities of the toner at different temperatures (specifically at 130° C., 90° C., 60° C., and 40° C.) are values measured by the following method.

In the present exemplary embodiment, the viscosities of the toner are measured using a rotary flat plate rheometer (RDA 2RHIOS system ver. 4.3.2 manufactured by Rheometric Scientific). The viscosities at these temperatures are values measured by placing 0.3 g of a sample between parallel plates having a diameter of 8 mm and heating the sample in the range of about 30° C. to 150° C. at a heating rate of 1° C./min with a distortion of 20% or less applied at a frequency of 1 Hz.

(ln η(T1)−ln η(T2))/(T1−T2), which is one of the characteristic values of the specific toner, is −0.14 or less. From the viewpoint of more effectively preventing the occurrence of a gradation pattern corresponding to surface irregularities of a recording medium, this value is preferably −0.16 or less, more preferably from −0.30 to −0.18 inclusive, and particularly preferably from −0.25 to −0.20 inclusive.

(ln η(T2)−ln η(T3))/(T2−T3), which is one of the characteristic values of the specific toner, is −0.15 or more. From the viewpoint of more effectively preventing the occurrence of a gradation pattern corresponding to surface irregularities of a recording medium, this value is preferably more than −0.14, more preferably −0.13 or more, still more preferably from −0.12 to −0.03 inclusive, and particularly preferably from −0.11 to −0.05 inclusive.

In the specific toner, (ln η(T2)−ln η(T3))/(T2−T3) is larger than (ln η(T1)−ln η(T2))/(T1−T2). From the viewpoint of more effectively preventing the occurrence of a gradation pattern corresponding to surface irregularities of a recording medium, the value of {(ln η(T2)−ln η(T3))/(T2−T3)}−{(ln η(T1)−ln η(T2))/(T1−T2)} is preferably 0.01 or more, more preferably from 0.05 to 0.5 inclusive, and particularly preferably from 0.08 to 0.2 inclusive.

Let the viscosity η of the specific toner at T0=40° C. be η(T0). Then, from the viewpoint of more effectively preventing the occurrence of a gradation pattern corresponding to surface irregularities of a recording medium, it is preferable that (ln η(T0)−ln η(T1))/(T0−T1) is −0.12 or more and that (ln η(T0)−ln η(T1))/(T0−T1) is larger than (ln η(T1)−ln η(T2))/(T1−T2).

When (ln η(T0)−ln η(T1))/(T0−T1) in the specific toner is −0.12 or more, the occurrence of a gradation pattern corresponding to surface irregularities of a recording medium is more effectively prevented. (ln η(T0)−ln η(T1))/(T0−T1) is more preferably −0.05 or less and particularly preferably from −0.11 to −0.06 inclusive.

In the specific toner, when (ln η(T0)−ln η(T1))/(T0−T1) is larger than (ln η(T1)−ln η(T2))/(T1−T2), the occurrence of a gradation pattern corresponding to surface irregularities of a recording medium is more effectively prevented. The value of {(ln η(T0)−ln η(T1))/(T0−T1)}−{(ln η(T1)−ln η(T2))/(T1−T2)} is preferably 0.01 or more, more preferably from 0.05 to 0.5 inclusive, and particularly preferably from 0.08 to 0.2 inclusive.

No particular limitation is imposed on the method for controlling the characteristic values of the viscosity at the above temperatures, i.e., (ln η(T1)−ln η(T2))/(T1−T2), (ln η(T2)−ln η(T3))/(T2−T3), and (ln η(T0)−ln η(T1))/(T0−T1), within the above ranges.

Specific examples of the method include a method in which the molecular weight of the binder resin contained in the toner particles is controlled. More particularly, the molecular weights of a low molecular weight component and a high molecular weight component in the binder resin and their contents are controlled. When an aggregation/coalescence method described later is used to produce the toner particles, the degree of aggregation may be controlled, for example, by changing the amount of a flocculant added to control the characteristic values of the viscosity.

In the specific toner, from the viewpoint of more effectively preventing the occurrence of a gradation pattern corresponding to surface irregularities of a recording medium, the viscosity η(T0) of the toner at T0=40° C., the viscosity η(T1) of the toner at T1=60° C., the viscosity η(T2) of the toner at T2=90° C., and the viscosity η(T3) of the toner at T3=130° C. are preferably within the following ranges.

- η(T0): from $1.0\times10^7$ to $1.0\times10^9$ inclusive (more preferably from $2.0\times10^7$ to $5.0\times10^8$ inclusive)
- η(T1): from $1.0\times10^5$ to $1.0\times10^8$ inclusive (more preferably from $1.0\times10^6$ to $5.0\times10^7$ inclusive)
- η(T2): from $1.0\times10^3$ to $1.0\times10^5$ inclusive (more preferably from $5.0\times10^3$ to $5.0\times10^4$ inclusive)
- η(T3): from $1.0\times10^2$ to $1.0\times10^4$ inclusive (more preferably from $1.0\times10^2$ to $5.0\times10^3$ inclusive)

(Maximum Endothermic Peak Temperature)

From the viewpoint of controlling the viscosity of the specific toner, more effectively preventing the occurrence of a gradation pattern corresponding to surface irregularities of a recording medium, and improving the fixability of the toner, the maximum endothermic peak temperature of the specific toner is preferably from 70° C. to 100° C. inclusive, more preferably from 75° C. to 95° C. inclusive, and particularly preferably from 83° C. to 93° C. inclusive.

The maximum endothermic peak temperature of the specific toner is the temperature giving the maximum endothermic peak in an endothermic curve in the range of at least −30° C. to 150° C. in differential scanning calorimetry.

A method for measuring the maximum endothermic peak temperature of the specific toner is shown below.

A differential scanning calorimeter DSC-7 manufactured by PerkinElmer Co., Ltd. is used. To correct the temperature of a detection unit of the device, the melting points of indium and zinc are used. To correct the amount of heat, the heat of fusion of indium is used. An aluminum-made pan is used for a sample, and an empty pan is used for a control. The sample is heated from room temperature to 150° C. at a heating rate of 10° C./min, cooled from 150° C. to −30° C. at a rate of 10° C./min, and heated from −30° C. to 150° C. at a rate of 10° C./min. The temperature at the largest endothermic peak during the second heating is used as the maximum endothermic peak temperature.

(Infrared Absorption Spectrum of Toner Particles)

The specific toner may contain, as the binder resin, an amorphous polyester resin described later. In this case, from the viewpoint of controlling the viscosity of the toner and more effectively preventing the occurrence of a gradation pattern corresponding to surface irregularities of a recording medium, it is preferable that the ratio of the absorbance of the toner particles at a wavenumber of 1,500 $cm^{-1}$ in infrared absorption spectrum analysis to the absorbance at a wavenumber of 720 $cm^{-1}$ (the absorbance at a wavenumber of 1,500 $cm^{-1}$/the absorbance at a wavenumber of 720 $cm^{-1}$) is 0.6 or less and that the ratio of the absorbance at a wavenumber of 820 $cm^{-1}$ to the absorbance at a wavenumber of 720 $cm^{-1}$ (the absorbance at a wavenumber of 820 $cm^{-1}$/the absorbance at a wavenumber of 720 $cm^{-1}$) is 0.4 or less. It is more preferable that the ratio of the absorbance of the toner particles at a wavenumber of 1,500 $cm^{-1}$ in infrared absorption spectrum analysis to the absorbance at a wavenumber of 720 $cm^{-1}$ is 0.4 or less and that the ratio of the absorbance at a wavenumber of 820 $cm^{-1}$ to the absorbance at a wavenumber of 720 $cm^{-1}$ is 0.2 or less. It is particularly preferable that the ratio of the absorbance of the toner particles at a wavenumber of 1,500 $cm^{-1}$ in infrared absorption spectrum analysis to the absorbance at a wavenumber of 720 $cm^{-1}$ is from 0.2 to 0.4 inclusive and that the ratio of the absorbance at a wavenumber of 820 $cm^{-1}$ to the absorbance at a wavenumber of 720 $cm^{-1}$ is from 0.05 to 0.2 inclusive.

The absorbances at the above wavenumbers in the infrared absorption spectrum analysis in the present exemplary embodiment are measured by the following method.

First, toner particles used for the measurement (toner particles with the external additive optionally removed from the toner) are used to prepare a measurement sample by a KBr pellet method. The measurement sample is subjected to measurement using an infrared spectrophotometer (FT-IR-410 manufactured by JASCO Corporation) in the wavenumber range of from 500 $cm^{-1}$ to 4,000 $cm^{-1}$ inclusive under the conditions of a number of times of integration of 300 and a resolution of 4 $cm^{-1}$. Baseline correction is carried out, for example, at an offset portion with no light absorption, and then the absorbances at the above wavelengths are determined.

In the specific toner, the ratio of the absorbance of the toner particles at a wavenumber of 1,500 $cm^{-1}$ in the infrared absorption spectrum analysis to the absorbance at a wavenumber of 720 $cm^{-1}$ is preferably 0.6 or less, more preferably 0.4 or less, still more preferably from 0.2 to 0.4 inclusive, and particularly preferably from 0.3 to 0.4 inclusive.

In the specific toner, the ratio of the absorbance of the toner particles at a wavenumber of 820 $cm^{-1}$ in the infrared absorption spectrum analysis to the absorbance at a wavenumber of 720 $cm^{-1}$ is preferably 0.4 or less, more preferably 0.2 or less, still more preferably from 0.05 to 0.2 inclusive, and particularly preferably from 0.08 to 0.2 inclusive.

(Toner Particles)

The toner particles contain, for example, a binder resin and optionally contain a coloring agent, a release agent, and an additional additive. In particular, the toner particles may contain a binder resin and a release agent.

No particular limitation is imposed on the toner particles, and the toner particles may be: particles such as yellow toner particles, magenta toner particles, cyan toner particles, or black toner particles; white toner particles; transparent toner particles; or brilliant toner particles.

—Binder Resin—

Examples of the binder resin include: vinyl resins composed of homopolymers of monomers such as styrenes (such as styrene, p-chlorostyrene, and α-methylstyrene), (meth) acrylates (such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (such as acrylonitrile and methacrylonitrile), vinyl ethers (such as vinyl methyl ether and vinyl isobutyl ether), vinyl ketones (such as vinyl methyl ketone, vinyl ethyl ketone, and vinyl isopropenyl ketone), and olefins (such as ethylene, propylene, and butadiene); and vinyl resins composed of copolymers of combinations of two or more of the above monomers.

Other examples of the binder resin include: non-vinyl resins such as epoxy resins, polyester resins, polyurethane resins, polyamide resins, cellulose resins, polyether resins, and modified rosins; mixtures of the non-vinyl resins and the above-described vinyl resins; and graft polymers obtained by polymerizing a vinyl monomer in the presence of any of these resins.

Any of these binder resins may be used alone or in combination of two or more.

In particular, from the viewpoint of ease of controlling the viscosity of the toner and more effectively preventing the occurrence of a gradation pattern corresponding to surface irregularities of a recording medium, the binder resin contains preferably at least one selected from the group consisting of styrene-acrylic resins and amorphous polyester resins and contains more preferably a styrene-acrylic resin or an amorphous polyester resin. The styrene-acrylic resin or the amorphous polyester resin is contained in an amount of more preferably 50% by mass or more based on the total mass of the binder resin contained in the toner. The styrene-acrylic resin or the amorphous polyester resin is contained in an amount of particularly preferably 80% by mass or more based on the total mass of the binder resin contained in the toner.

From the viewpoint of the strength and storage stability of the toner, it is preferable that the specific toner contains as the binder resin a styrene-acrylic resin.

From the viewpoint of low-temperature fixability, it is preferable that the specific toner contains as the binder resin an amorphous polyester resin.

From the viewpoint of fixability, it is preferable that the amorphous polyester resin is an amorphous polyester resin not containing a bisphenol structure.

(1) Styrene-Acrylic Resin

The styrene-acrylic resin suitable as the binder resin is a copolymer obtained by copolymerization of at least a styrene-based monomer (a monomer having a styrene skeleton) and a (meth)acrylic-based monomer (a monomer having a (meth)acrylic group, preferably a monomer having a (meth) acryloxy group). The styrene-acrylic resin contains, for example, a copolymer of a styrene-based monomer and the (meth)acrylate monomer.

The acrylic resin portions of the styrene-acrylic resin are partial structures obtained by polymerizing an acrylic-based monomer, a methacrylic monomer, or both of them. The term "(meth)acrylic" refers to either "acrylic" or "methacrylic."

Specific examples of the styrene-based monomer include styrene, alkyl-substituted styrenes (such as α-methylstyrene, 2-methylstyrene, 3-methylstyrene, 4-methylstyrene, 2-ethylstyrene, 3-ethylstyrene, and 4-ethylstyrene), halogen-substituted styrenes (such as 2-chlorostyrene, 3-chlorostyrene, and 4-chlorostyrene), and vinylnaphthalene. Any of these styrene-based monomers may be used alone or in combination of two or more.

In particular, from the viewpoint of ease of reaction, ease of controlling the reaction, and availability, the styrene-based monomer is preferably styrene.

Specific examples of the (meth)acrylic-based monomer include (meth)acrylic acid and (meth)acrylates. Examples of the (meth)acrylates include alkyl (meth)acrylates (such as methyl (meth)acrylate, ethyl (meth)acrylate, n-propyl (meth)acrylate, n-butyl (meth)acrylate, n-pentyl (meth)acrylate, n-hexyl (meth)acrylate, n-heptyl (meth)acrylate, n-octyl (meth)acrylate, n-decyl (meth)acrylate, n-dodecyl (meth) acrylate, n-lauryl (meth)acrylate, n-tetradecyl (meth) acrylate, n-hexadecyl (meth)acrylate, n-octadecyl (meth) acrylate, isopropyl (meth)acrylate, isobutyl (meth)acrylate, t-butyl (meth)acrylate, isopentyl (meth)acrylate, amyl (meth)acrylate, neopentyl (meth)acrylate, isohexyl (meth) acrylate, isoheptyl (meth)acrylate, isooctyl (meth)acrylate, 2-ethylhexyl (meth)acrylate, cyclohexyl (meth)acrylate, and t-butylcyclohexyl (meth)acrylate), aryl (meth)acrylates (such as phenyl (meth)acrylate, biphenyl (meth)acrylate, diphenylethyl (meth)acrylate, t-butylphenyl (meth)acrylate, and terphenyl (meth)acrylate), dimethylaminoethyl (meth) acrylate, diethylaminoethyl (meth)acrylate, methoxyethyl (meth)acrylate, 2-hydroxyethyl (meth)acrylate, β-carboxyethyl (meth)acrylate, and (meth)acrylamide. Any of these (meth)acrylic-based monomers may be used alone or in combination of two or more.

Among these (meth)acrylic-based monomers, (meth) acrylates are preferable. From the viewpoint of fixability, (meth)acrylates having an alkyl group having 2 to 14 carbon atoms (preferably 2 to 10 carbon atoms and more preferably 3 to 8 carbon atoms) are preferable.

In particular, n-butyl (meth)acrylate is preferable, and n-butyl acrylate is particularly preferable.

No particular limitation is imposed on the copolymerization ratio of the styrene-based monomer and the (meth) acrylic-based monomer (mass ratio: styrene-based monomer/(meth)acrylic-based monomer), but the copolymerization ratio may be 85/15 to 70/30.

From the viewpoint of the strength and storage stability of the toner, the styrene-acrylic resin may have a cross-linked structure. Preferred examples of the styrene-acrylic resin having a cross-linked structure include a copolymer of at least a styrene-based monomer, a (meth)acrylic acid-based monomer, and a cross-linkable monomer.

Examples of the cross-linkable monomer include bifunctional and higher functional cross-linking agents.

Examples of the bifunctional cross-linking agents include divinylbenzene, divinylnaphthalene, di(meth)acrylate compounds (such as diethylene glycol di(meth)acrylate, methylenebis(meth)acrylamide, decanediol diacrylate, and glycidyl (meth)acrylate), polyester-type di(meth)acrylate, and 2-([1'-methylpropylideneamino]carboxyamino)ethyl methacrylate.

Examples of the polyfunctional cross-linking agent include tri(meth)acrylate compounds (such as pentaerythritol tri(meth)acrylate, trimethylolethane tri(meth)acrylate, and trimethylolpropane tri(meth)acrylate), tetra(meth)acrylate compounds (such as pentaerythritol tetra(meth)acrylate and oligoester (meth)acrylate), 2,2-bis(4-methacryloxy, polyethoxyphenyl)propane, diallyl phthalate, triallyl cyanurate, triallyl isocyanurate, triallyl trimellitate, and diallyl chlorendate.

From the viewpoint of the strength, storage stability, and fixability of the toner, the cross-linkable monomer is preferably a bifunctional or higher functional (meth)acrylate compound, more preferably a bifunctional (meth)acrylate compound, still more preferably a bifunctional (meth)acrylate compound having an alkylene group having 6 to 20 carbon atoms, and particularly preferably a bifunctional (meth)acrylate compound having a linear alkylene group having 6 to 20 carbon atoms.

No particular limitation is imposed on the copolymerization ratio of the cross-linkable monomer to the total mass of the monomers (mass ratio: cross-linkable monomer/all the monomers), but the copolymerization ratio may be 2/1,000 to 20/1,000.

From the viewpoint of fixability, the glass transition temperature (Tg) of the styrene-acrylic resin is preferably from 40° C. to 75° C. inclusive and more preferably from 50° C. to 65° C. inclusive.

The glass transition temperature is determined using a DSC curve obtained by differential scanning calorimetry (DSC). More specifically, the glass transition temperature is determined from "extrapolated glass transition onset temperature" described in glass transition temperature determination methods in "Testing methods for transition temperatures of plastics" in JIS K7121-1987.

From the viewpoint of storage stability, the weight average molecular weight of the styrene-acrylic resin is preferably from 5,000 to 200,000 inclusive, more preferably from 10,000 to 100,000 inclusive, and particularly preferably from 20,000 to 80,000 inclusive.

No particular limitation is imposed on the method for producing the styrene-acrylic resin, and any of various polymerization methods (such as solution polymerization, precipitation polymerization, suspension polymerization, bulk polymerization, and emulsion polymerization) may be used. A well-known procedure (such as a batch procedure, a semi-continuous procedure, or a continuous procedure) may be used for the polymerization reaction.

(2) Polyester Resin

Suitable examples of the polyester resin used as the binder resin include well-known amorphous polyester resins. The polyester resin used may be a combination of an amorphous polyester resin and a crystalline polyester resin. The amount of the crystalline polyester resin used may be from 2% by mass to 40% by mass inclusive (preferably from 2% by mass to 20% by mass inclusive) based on the total mass of the binder resin.

The "crystalline" resin means that, in differential scanning calorimetry (DSC), a clear endothermic peak is observed instead of a stepwise change in the amount of heat absorbed. Specifically, the half width of the endothermic peak when the measurement is performed at a heating rate of 10 (° C./min) is 10° C. or less.

The "amorphous" resin means that the half width exceeds 10° C., that a stepwise change in the amount of heat absorbed is observed, or that a clear endothermic peak is not observed.

—Amorphous Polyester Resin

The amorphous polyester resin may be, for example, a polycondensation product of a polycarboxylic acid and a polyhydric alcohol. The amorphous polyester resin used may be a commercial product or a synthesized product.

Examples of the polycarboxylic acid include aliphatic dicarboxylic acids (such as oxalic acid, malonic acid, maleic acid, fumaric acid, citraconic acid, itaconic acid, glutaconic acid, succinic acid, alkenyl succinic acids, adipic acid, and sebacic acid), alicyclic dicarboxylic acids (such as cyclohexanedicarboxylic acid), aromatic dicarboxylic acids (such as terephthalic acid, isophthalic acid, phthalic acid, and naphthalenedicarboxylic acid), anhydrides thereof, and lower alkyl (e.g., having 1 to 5 carbon atoms) esters thereof. In particular, the polycarboxylic acid is, for example, preferably an aromatic dicarboxylic acid.

The polycarboxylic acid used may be a combination of a dicarboxylic acid and a tricarboxylic or higher polycarboxylic acid having a crosslinked or branched structure. Examples of the tricarboxylic or higher polycarboxylic acid include trimellitic acid, pyromellitic acid, anhydrides thereof, and lower alkyl (e.g., having 1 to 5 carbon atoms) esters thereof.

Any of these polycarboxylic acids may be used alone or in combination of two or more.

Examples of the polyhydric alcohol include aliphatic diols (such as ethylene glycol, diethylene glycol, triethylene glycol, propylene glycol, butanediol, hexanediol, and neopentyl glycol), alicyclic diols (such as cyclohexanediol, cyclohexanedimethanol, and hydrogenated bisphenol A), and aromatic diols (such as an ethylene oxide adduct of bisphenol A and a propylene oxide adduct of bisphenol A). In particular, the polyhydric alcohol is, for example, preferably an aromatic diol or an alicyclic diol and more preferably an aromatic diol.

The polyhydric alcohol used may be a combination of a diol and a trihydric or higher polyhydric alcohol having a crosslinked or branched structure. Examples of the trihydric or higher polyhydric alcohol include glycerin, trimethylolpropane, and pentaerythritol.

Any of these polyhydric alcohols may be used alone or in combination or two or more.

The glass transition temperature (Tg) of the amorphous polyester resin is preferably from 50° C. to 80° C. inclusive and more preferably from 50° C. to 65° C. inclusive.

The glass transition temperature is determined from a DSC curve obtained by differential scanning calorimetry (DSC). More specifically, the glass transition temperature is determined from "extrapolated glass transition onset temperature" described in glass transition temperature determination methods in "Testing methods for transition temperatures of plastics" in JIS K7121-1987.

The weight average molecular weight (Mw) of the amorphous polyester resin is preferably from 5,000 to 1,000,000 inclusive and more preferably from 7,000 to 500,000 inclusive.

The number average molecular weight (Mn) of the amorphous polyester resin may be from 2,000 to 100,000 inclusive.

The molecular weight distribution Mw/Mn of the amorphous polyester resin is preferably from 1.5 to 100 inclusive and more preferably from 2 to 60 inclusive.

The weight average molecular weight and the number average molecular weight are measured by gel permeation chromatography (GPC). In the molecular weight distribution measurement by GPC, a GPC measurement apparatus HLC-8120GPC manufactured by TOSOH Corporation is used, and a TSKgel Super HM-M (15 cm) column manufactured by TOSOH Corporation and a THF solvent are used. The weight average molecular weight and the number average molecular weight are computed from the measurement results using a molecular weight calibration curve produced using monodispersed polystyrene standard samples.

The amorphous polyester resin can be obtained by a well-known production method. For example, in one production method, the polymerization temperature is set to from 180° C. to 230° C. inclusive. If necessary, the pressure of the reaction system is reduced, and the reaction is allowed to proceed while water and alcohol generated during condensation are removed.

When raw material monomers are not dissolved or not compatible with each other at the reaction temperature, a high-boiling point solvent serving as a solubilizer may be added to dissolve the monomers. In this case, the polycondensation reaction is performed while the solubilizer is removed by evaporation. When a monomer with poor compatibility is present in the copolymerization reaction, the monomer with poor compatibility and an acid or an alcohol to be polycondensed with the monomer are condensed in advance and then the resulting polycondensation product and the rest of the components are subjected to polycondensation.

—Crystalline Polyester Resin

The crystalline polyester resin is, for example, a polycondensation product of a polycarboxylic acid and a polyhydric alcohol. The crystalline polyester resin used may be a commercial product or a synthesized product.

The crystalline polyester resin is preferably a polycondensation product using a polymerizable monomer having a linear aliphatic group rather than using a polymerizable monomer having an aromatic group, in order to facilitate the formation of a crystalline structure.

Examples of the polycarboxylic acid include aliphatic dicarboxylic acids (such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid), aromatic dicarboxylic acids (such as dibasic acids such as phthalic acid, isophthalic acid, terephthalic acid, and naphthalene-2,6-dicarboxylic acid), anhydrides thereof, and lower alkyl (e.g., having 1 to 5 carbon atoms) esters thereof.

The polycarboxylic acid used may be a combination of a dicarboxylic acid and a tricarboxylic or higher polycarboxylic acid having a crosslinked or branched structure. Examples of the tricarboxylic acid include aromatic carboxylic acids (such as 1,2,3-benzenetricarboxylic acid, 1,2,4-benzenetricarboxylic acid, and 1,2,4-naphthalene tricarboxylic acid), anhydrides thereof, and lower alkyl (e.g., having 1 to 5 carbon atoms) esters thereof.

The polycarboxylic acid used may be a combination of a dicarboxylic acid, a dicarboxylic acid having a sulfonic acid group, and a dicarboxylic acid having an ethylenic double bond.

Any of these polycarboxylic acids may be used alone or in combination of two or more.

The polyhydric alcohol may be, for example, an aliphatic diol (e.g., a linear aliphatic diol with a main chain having 7 to 20 carbon atoms). Examples of the aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. In particular, the aliphatic diol is preferably 1,8-octanediol, 1,9-nonanediol, or 1,10-decanediol.

The polyhydric alcohol used may be a combination of a diol and a trihydric or higher polyhydric alcohol having a crosslinked or branched structure. Examples of the trihydric or higher polyhydric alcohol include glycerin, trimethylolethane, trimethylolpropane, and pentaerythritol.

Any of these polyhydric alcohols may be used alone or in combination of two or more.

In the polyhydric alcohol, the content of the aliphatic diol may be 80% by mole or more and preferably 90% by mole or more.

The melting temperature of the crystalline polyester resin is preferably from 50° C. to 100° C. inclusive, more preferably from 55° C. to 90° C. inclusive, and still more preferably from 60° C. to 85° C. inclusive.

The melting temperature is determined using a DSC curve obtained by differential scanning calorimetry (DSC) from "peak melting temperature" described in melting temperature determination methods in "Testing methods for transition temperatures of plastics" in JIS K7121-1987.

The weight average molecular weight (Mw) of the crystalline polyester resin may be from 6,000 to 35,000 inclusive.

Like the amorphous polyester resin, the crystalline polyester resin is obtained by a well-known production method.

The content of the binder resin is, for example, preferably from 40% by mass to 95% by mass inclusive, more preferably from 50% by mass to 90% by mass inclusive, and still more preferably from 60% by mass to 85% by mass inclusive based on the total mass of the toner particles.

When the toner particles are white toner particles, the content of the binder resin is preferably from 30% by mass to 85% by mass inclusive and more preferably from 40% by mass to 60% by mass inclusive based on the total mass of the white toner particles.

—Coloring Agent—

Examples of the coloring agent include: various pigments such as carbon black, chrome yellow, Hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, DuPont oil red, pyrazolone red, lithol red, rhodamine B lake, lake red C, pigment red, rose bengal, aniline blue, ultramarine blue, calco oil blue, methylene blue chloride, phthalocyanine blue, pigment blue, phthalocyanine green, malachite green oxalate, titanium oxide, zinc oxide, calcium carbonate, basic lead carbonate, a mixture of zinc sulfide and barium sulfate, zinc sulfide, silicon dioxide, and aluminum oxide; and various dyes such as acridine-based dyes, xanthene-based dyes, azo-based dyes, benzoquinone-based dyes, azine-based dyes, anthraquinone-based dyes, thioindigo-based dyes, dioxazine-based dyes, thiazine-based dyes, azomethine-based dyes, indigo-based dyes, phthalocyanine-based dyes, aniline black-based dyes, polymethine-based dyes, triphenylmethane-based dyes, diphenylmethane-based dyes, and thiazole-based dyes.

When the toner particles are white toner particles, the coloring agent used may be a white pigment.

The white pigment is preferably titanium oxide or zinc oxide and more preferably titanium oxide.

Any of these coloring agents may be used alone or in combination of two or more.

The coloring agent used may be optionally subjected to surface treatment or may be used in combination with a dispersant. A plurality of coloring agents may be used in combination.

The content of the coloring agent is, for example, preferably from 1% by mass to 30% by mass inclusive and more preferably from 3% by mass to 15% by mass inclusive based on the total mass of the toner particles.

When the toner particles are white toner particles, the content of the white pigment is preferably from 15% by mass to 70% by mass inclusive and more preferably from 20% by mass to 60% by mass inclusive based on the total mass of the white toner particles.

—Release Agent—

Examples of the release agent include: hydrocarbon-based waxes; natural waxes such as carnauba wax, rice wax, and candelilla wax; synthetic and mineral/petroleum-based waxes such as montan wax; and ester-based waxes such as fatty acid esters and montanic acid esters. However, the release agent is not limited to these waxes.

From the viewpoint of obtaining releasability, the melting temperature of the release agent is preferably from 50° C. to 110° C. inclusive, more preferably from 70° C. to 100° C. inclusive, still more preferably from 75° C. to 95° C. inclusive, and particularly preferably from 83° C. to 93° C. inclusive.

The melting temperature of the release agent is determined using a DSC curve obtained by differential scanning calorimetry (DSC) from "peak melting temperature" described in melting temperature determination methods in "Testing methods for transition temperatures of plastics" in JIS K7121-1987.

Let the number of release agent domains with an aspect ratio of 5 or more in the particles of the specific toner be "a," and the number of release agent domains with an aspect ratio of less than 5 be "b." Then, from the viewpoint of ease of control of the viscosity of the toner and more effectively preventing the occurrence of a gradation pattern corresponding to surface irregularities of a recording medium, it is preferable that $1.0<a/b<8.0$ holds. It is more preferable that $2.0<a/b<7.0$ holds, and it is particularly preferable that $3.0<a/b<6.0$ holds.

Let the total cross-sectional area of release agent domains with an aspect ratio of 5 or more in the particles of the specific toner be "c," and the total cross-sectional area of release agent domains with an aspect ratio of less than 5 be "d." Then, from the viewpoint of ease of control of the viscosity of the toner and more effectively preventing the occurrence of a gradation pattern corresponding to surface irregularities of a recording medium, it is preferable that $1.0<c/d<4.0$ holds. It is more preferable that $1.5<c/d<3.5$ holds, and it is particularly preferable that $2.0<c/d<3.0$ holds.

The aspect ratio of the release agent in the toner is measured by the following method.

The toner is mixed into an epoxy resin, and the epoxy resin is cured. The cured product obtained is cut using an ultramicrotome (Ultracut UCT manufactured by Leica) to produce a thin sample with a thickness of from 80 nm to 130 nm inclusive. The thin sample is stained with ruthenium tetroxide for 3 hours in a desiccator at 30° C. Then an SEM image of the stained thin sample is obtained under an ultra-high-resolution field-emission scanning electron microscope (FE-SEM) (e.g., S-4800 manufactured by Hitachi High-Technologies Corporation). Generally, the release agent is more easily stained with ruthenium tetroxide than the binder resin and is therefore identified by gradation caused by the degree of staining. The difference in gradation may not be clear for some samples. In this case, the time of staining is adjusted. In cross sections of toner particles, coloring agent domains are generally smaller than release agent domains, and they can be distinguished from each other based on their size.

The SEM image contains cross sections of toner particles with different sizes. Cross sections of toner particles with diameters equal to or larger than 85% of the volume average particle diameter of the toner particles are selected, and the cross sections of 100 toner particles are selected arbitrary from the selected particles and observed. The diameter of the cross section of a toner particle is the maximum length between two points on the outline of the cross section of the toner particle (i.e., the major axis).

In the SEM image, image analysis is performed on each of the cross sections of the selected 100 particles using image analysis software WINROOF (manufactured by MITANI CORPORATION) under the condition of 0.010000 μm/pixel. In the image analysis, the image of the cross sections of the toner particles can be observed based on the difference in brightness (contrast) between the embedding epoxy resin and the binder resin of the toner particles. Using the image observed, the major axis length, minor axis length, aspect ratio (the major axis length/the minor axis length), and cross-sectional area of each of the release agent domains in the toner particles can be determined.

Examples of the method for controlling the aspect ratio of the release agent in the toner include a method in which the release agent is held at a temperature around the freezing point of the release agent for a given time during cooling to grow the crystals of the release agent and a method in which two or more types of release agents with different melting temperatures are used such that crystal growth during cooling is facilitated.

The content of the release agent is, for example, preferably from 1% by mass to 20% by mass inclusive and more preferably from 5% by mass to 15% by mass inclusive based on the total mass of the toner particles.

—Additional Additives—

Examples of additional additives include well-known additives such as a magnetic material, a charge control agent, and an inorganic powder. These additives are contained in the toner particles as internal additives.

—Characteristics Etc. of Toner Particles—

The toner particles may have a single layer structure or may be core shell toner particles each having a so-called core shell structure including a core (core particle) and a coating layer (shell layer) covering the core.

The toner particles having the core shell structure may each include, for example: a core containing the binder resin and optional additives such as the coloring agent and the release agent; and a coating layer containing the binder resin.

The volume average particle diameter (D50v) of the toner particles is preferably from 2 μm to 10 μm inclusive and more preferably from 4 μm to 8 μm inclusive.

The volume average particle diameter of the toner particles is measured using COULTER MULTISIZER II (manufactured by Beckman Coulter, Inc.), and ISOTON-II (manufactured by Beckman Coulter, Inc.) is used as an electrolyte.

In the measurement, 0.5 mg to 50 mg of a measurement sample is added to 2 mL of a 5% by mass aqueous solution of a surfactant (preferably sodium alkylbenzenesulfonate) serving as a dispersant. The mixture is added to 100 mL to 150 mL of the electrolyte.

The electrolyte with the sample suspended therein is subjected to dispersion treatment for 1 minute using an ultrasonic dispersion apparatus, and then the particle size distribution of particles having diameters within the range of 2 μm to 60 μm is measured using the COULTER MULTISIZER II with an aperture having an aperture diameter of 100 μm. The number of particles sampled is 50,000.

The particle size distribution measured and divided into particle size ranges (channels) is used to obtain a volumetric cumulative distribution computed from the small diameter side, and the particle diameter at a cumulative frequency of 50% is defined as the volume average particle diameter D50v.

No particular limitation is imposed on the average circularity of the toner particles. However, from the viewpoint of improving the ease of cleaning the toner from an image-holding member, the average circularity is preferably from 0.91 to 0.98 inclusive, more preferably from 0.94 to 0.98 inclusive, and still more preferably from 0.95 to 0.97 inclusive.

The circularity of a toner particle is determined as (the peripheral length of an equivalent circle of the toner particle)/(the peripheral length of the toner particle) (i.e., the peripheral length of a circle having the same area as a projection image of the particle/the peripheral length of the projection image of the particle). Specifically, the average circularity is a value measured by the following method.

First, the toner particles used for the measurement are collected by suction, and a flattened flow of the particles is formed. Particle images are captured as still images using flashes of light, and the average circularity is determined by subjecting the particle images to image analysis using a flow-type particle image analyzer (e.g., FPIA-3000 manufactured by SYSMEX Corporation). The number of sampled particles for determination of the average circularity is 3,500.

When the toner contains the external additive, the toner (developer) for the measurement is dispersed in water containing a surfactant, and the dispersion is subjected to ultrasonic treatment, whereby the toner particles with the external additive removed are obtained.

When the toner particles are produced, for example, by an aggregation/coalescence method, the average circularity of the toner particles can be controlled by adjusting the stirring rate of a dispersion, the temperature of the dispersion, or the retention time in a fusion/coalescence step.

(External Additive)

Examples of the external additive include inorganic particles. Examples of the inorganic particles include particles of $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, CaO—$SiO_2$, $K_2O.(TiO_2)n$, $Al_2O3.2SiO_2$, $CaCO_3$, $MgCO_3$, $BaSO_4$, and $MgSO_4$.

The surface of the inorganic particles used as the external additive may be subjected to hydrophobic treatment. The hydrophobic treatment is performed, for example, by immersing the inorganic particles in a hydrophobic treatment agent. No particular limitation is imposed on the hydrophobic treatment agent, and examples of the hydrophobic treatment agent include silane-based coupling agents, silicone oils, titanate-based coupling agents, and aluminum-based coupling agents. Any of these may be used alone or in combination of two or more.

The amount of the hydrophobic treatment agent is generally, for example, from 1 part by mass to 10 parts by mass inclusive based on 100 parts by mass of the inorganic particles.

Other examples of the external additive include resin particles (particles of resins such as polystyrene, polymethyl methacrylate (PMMA), and melamine resins) and cleaning activators (such as metal salts of higher fatty acids typified by zinc stearate and fluorine-based polymer particles).

The amount of the external additive added externally is, for example, preferably from 0.01% by mass to 10% by mass inclusive and more preferably from 0.01% by mass to 6% by mass inclusive based on the mass of the toner particles.

(Method for Producing Toner)

Next, a method for producing the specific toner will be described.

The specific toner is obtained by producing toner particles and then externally adding the external additive to the toner particles produced.

The toner particles may be produced by a dry production method (such as a kneading-grinding method) or by a wet production method (such as an aggregation/coalescence method, a suspension polymerization method, or a dissolution/suspension method). No particular limitation is imposed on the toner particle production method, and any known production method may be used.

In particular, the aggregation/coalescence method may be used to obtain the toner particles.

Specifically, when the toner particles are produced, for example, by the aggregation/coalescence method, the toner particles are produced through: the step of preparing a resin particle dispersion in which resin particles used as the binder resin are dispersed (a resin particle dispersion preparing step); the step of aggregating the resin particles (and other optional particles) in the resin particle dispersion (the dispersion may optionally contain an additional particle dispersion mixed therein) to form aggregated particles (an aggregated particle forming step); and the step of heating the aggregated particle dispersion with the aggregated particles dispersed therein to fuse and coalesce the aggregated particles to thereby form the toner particles (a fusion/coalescence step).

These steps will next be described in detail.

In the following, a method for obtaining toner particles containing the coloring agent and the release agent will be described, but the coloring agent and the release agent are used optionally. Of course, additional additives other than the coloring agent and the release agent may be used.

—Resin Particle Dispersion Preparing Step—

The resin particle dispersion in which the resin particles used as the binder resin are dispersed is prepared, and, for example, a coloring agent particle dispersion in which coloring agent particles are dispersed and a release agent particle dispersion in which release agent particles are dispersed are prepared.

The resin particle dispersion is prepared, for example, by dispersing the resin particles in a dispersion medium using a surfactant.

Examples of the dispersion medium used for the resin particle dispersion include aqueous mediums.

Examples of the aqueous medium include: water such as distilled water and ion exchanged water; and alcohols. Any of these may be used alone or in combination of two or more.

Examples of the surfactant include: anionic surfactants such as sulfate-based surfactants, sulfonate-based surfactants, phosphate-based surfactants, and soap-based surfactants; cationic surfactants such as amine salt-based surfactants and quaternary ammonium salt-based surfactants; and nonionic surfactants such as polyethylene glycol-based surfactants, alkylphenol ethylene oxide adduct-based surfactants, and polyhydric alcohol-based surfactants. Of these, an anionic surfactant or a cationic surfactant may be used. A nonionic surfactant may be used in combination with the anionic surfactant or the cationic surfactant.

Any of these surfactants may be used alone or in combination of two or more.

To disperse the resin particles in the dispersion medium to form the resin particle dispersion, a commonly used dispersing method that uses, for example, a rotary shearing-type homogenizer, a ball mill using media, a sand mill, or a dyno-mill may be used. The resin particles may be dispersed in the dispersion medium by a phase inversion emulsification method, but this depends on the type of resin particles.

In the phase inversion emulsification method, the resin to be dispersed is dissolved in a hydrophobic organic solvent that can dissolve the resin, and a base is added to an organic continuous phase (0 phase) to neutralize it.

Then the aqueous medium (W phase) is added to change the form of the resin from W/O to O/W (so-called phase inversion) to thereby form a discontinuous phase, and the resin is thereby dispersed as particles in the aqueous medium.

The volume average particle diameter of the resin particles dispersed in the resin particle dispersion is, for example, preferably from 0.01 μm to 1 μm inclusive, more preferably from 0.08 μm to 0.8 μm inclusive, and still more preferably from 0.1 μm to 0.6 μm inclusive.

The volume average particle diameter of the resin particles is measured as follows. A particle size distribution measured by a laser diffraction particle size measurement apparatus (e.g., LA-700 manufactured by HORIBA Ltd.) is used and divided into different particle diameter ranges (channels), and a cumulative volume distribution computed from the small particle diameter side is determined. The particle diameter at which the cumulative frequency is 50% is measured as the volume average particle diameter D50v. The volume average particle diameters of particles in other dispersions are measured in the same manner.

The content of the resin particles contained in the resin particle dispersion is, for example, preferably from 5% by mass to 50% by mass inclusive and more preferably from 10% by mass to 40% by mass inclusive.

For example, the coloring agent particle dispersion and the release agent particle dispersion are prepared in a similar manner to the resin particle dispersion. Specifically, the descriptions of the volume average particle diameter of the particles in the resin particle dispersion, the dispersion medium for the resin particle dispersion, the dispersing method, and the content of the resin particles are applicable to the coloring agent particles dispersed in the coloring agent particle dispersion and the release agent particles dispersed in the release agent particle dispersion.

—Aggregated Particle Forming Step—

Next, the resin particle dispersion, the coloring agent particle dispersion, and the release agent particle dispersion are mixed.

Then the resin particles, the coloring agent particles, and the release agent particles are hetero-aggregated in the dispersion mixture to form aggregated particles containing the resin particles, the coloring agent particles, and the release agent particles and having diameters close to the diameters of target toner particles.

Specifically, for example, a flocculant is added to the dispersion mixture, and the pH of the dispersion mixture is adjusted to acidic (for example, a pH of from 2 to 5 inclusive). Then a dispersion stabilizer is optionally added, and the resulting mixture is heated to a temperature close to the glass transition temperature of the resin particles (specifically, for example, a temperature from the glass transition temperature of the resin particles—30° C. to the glass transition temperature—10° C. inclusive) to aggregate the particles dispersed in the dispersion mixture to thereby form aggregated particles.

In the aggregated particle forming step, the flocculant may be added at room temperature (e.g., 25° C.) while the dispersion mixture is agitated, for example, in a rotary shearing-type homogenizer. Then the pH of the dispersion mixture is adjusted to acidic (e.g., a pH of from 2 to 5 inclusive), and the dispersion stabilizer is optionally added. Then the resulting mixture is heated in the manner described above.

Examples of the flocculant include a surfactant with polarity opposite to the polarity of the surfactant added to the dispersion mixture, inorganic metal salts, and divalent or higher polyvalent metal complexes. In particular, when a metal complex is used as the flocculant, the amount of the surfactant used can be reduced, and charging characteristics are improved.

An additive that forms a complex with a metal ion in the flocculant or a similar bond may be optionally used. The additive used may be a chelating agent.

Examples of the inorganic metal salts include: metal salts such as calcium chloride, calcium nitrate, barium chloride, magnesium chloride, zinc chloride, aluminum chloride, and aluminum sulfate; and inorganic metal salt polymers such as polyaluminum chloride, polyaluminum hydroxide, and calcium polysulfide.

The chelating agent used may be a water-soluble chelating agent. Examples of the chelating agent include: oxycarboxylic acids such as tartaric acid, citric acid, and gluconic acid; iminodiacetic acid (IDA); nitrilotriacetic acid (NTA); and ethylenediaminetetraacetic acid (EDTA).

The amount of the chelating agent added is, for example, preferably from 0.01 parts by mass to 5.0 parts by mass inclusive and more preferably 0.1 parts by mass or more and less than 3.0 parts by mass based on 100 parts by mass of the resin particles.

—Fusion/Coalescence Step—

Next, the aggregated particle dispersion in which the aggregated particles are dispersed is heated, for example, to a temperature equal to or higher than the glass transition temperature of the resin particles (e.g., a temperature higher by 10° C. to 30° C. than the glass transition temperature of the resin particles) to fuse and coalesce the aggregated particles to thereby form toner particles.

Alternatively, the aggregated particle dispersion may be heated to a temperature equal to or higher than the melting temperature of the release agent to fuse and coalesce the aggregated particles to thereby form toner particles. In the fusion/coalescence step, the resin and the release agent are compatible with each other at the temperature equal to or higher than the glass transition temperature of the resin particles and equal to or higher than the melting temperature of the release agent. Then the dispersion is cooled to obtain a toner.

Examples of the method for controlling the aspect ratio of the release agent in the toner include a method in which the dispersion is held at a temperature around the freezing point of the release agent for a given time during cooling to grow the crystals of the release agent and a method in which two or more types of release agents with different melting temperatures are used to facilitate crystal growth during cooling.

The toner particles are obtained through the above-described steps.

Alternatively, the toner particles may be produced through: the step of, after the preparation of the aggregated particle dispersion containing the aggregated particles dispersed therein, mixing the aggregated particle dispersion further with the resin particle dispersion containing the resin particles dispersed therein and then causing the resin particles to adhere to the surface of the aggregated particles to aggregate them to thereby form second aggregated particles; and the step of heating a second aggregated particle dispersion containing the second aggregated particles dispersed therein to fuse and coalesce the second aggregated particles to thereby form toner particles having the core-shell structure.

After completion of the fusion/coalescence step, the toner particles formed in the solution are subjected to a well-known washing step, a solid-liquid separation step, and a drying step to obtain dried toner particles.

From the viewpoint of chargeability, the toner particles may be subjected to displacement washing with ion exchanged water sufficiently in the washing step. No particular limitation is imposed on the solid-liquid separation step. From the viewpoint of productivity, suction filtration, pressure filtration, etc. may be performed in the solid-liquid separation step. No particular limitation is imposed on the drying step. From the viewpoint of productivity, freeze-drying, flash drying, fluidized drying, vibrating fluidized drying, etc. may be performed in the drying step.

The specific toner is produced, for example, by adding the external additive to the dried toner particles obtained and mixing them. The mixing may be performed, for example, using a V blender, a HENSCHEL mixer, a Loedige mixer, etc. If necessary, coarse particles in the toner may be removed using a vibrating sieving machine, an air sieving machine, etc.

(Carrier)

No particular limitation is imposed on the carrier, and a well-known carrier may be used.

Examples of the carrier include: a coated carrier prepared by coating the surface of a core material formed of a magnetic powder with a coating resin; a magnetic powder-dispersed carrier prepared by dispersing a magnetic powder in a matrix resin; and a resin-impregnated carrier prepared by impregnating a porous magnetic powder with a resin.

In each of the magnetic powder-dispersed carrier and the resin-impregnated carrier, the particles included in the carrier may be used as cores, and the cores may be coated with a coating resin.

Examples of the magnetic powder include: magnetic metal powders such as iron powder, nickel powder, and cobalt powder; and magnetic oxide powders such as ferrite powder and magnetite powder.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymers, styrene-acrylate copolymers, straight silicone resins having organosiloxane bonds and modified products thereof, fluorocarbon resins, polyesters, polycarbonates, phenolic resins, and epoxy resins.

The coating resin and the matrix resin may contain an additional additive such as electrically conductive particles.

Examples of the electrically conductive particles include: particles of metals such as gold, silver, and copper; and particles of carbon black, titanium oxide, zinc oxide, tin oxide, barium sulfate, aluminum borate, and potassium titanate.

To coat the surface of the core material with a coating resin, the surface of the core material may be coated with a coating layer-forming solution prepared by dissolving the coating resin and various optional additives in an appropriate solvent. No particular limitation is imposed on the solvent, and the solvent may be selected in consideration of the type of the resin used, ease of coating, etc.

Specific examples of the resin coating method include: an immersion method in which the core material is immersed in the coating layer-forming solution; a spray method in which the coating layer-forming solution is sprayed onto the surface of the core material; a fluidized bed method in which the coating layer-forming solution is sprayed onto the core material floated by the flow of air; and a kneader-coater method in which the core material and the coating layer-forming solution are mixed in a kneader coater and then the solvent is removed.

The mixing ratio (mass ratio) of the toner and the carrier in the two-component developer is preferably toner:carrier=1:100 to 30:100 and more preferably 3:100 to 20:100.

[Specific Transfer Unit]

The specific transfer unit in the present exemplary embodiment includes a contact portion-forming member that contacts with the image holding member or the intermediate transfer body to form a contact portion and a transfer bias application unit that applies a transfer bias including a superimposed voltage to the contact portion. The superimposed voltage in the transfer bias has two peak values and is composed of an AC voltage and a DC voltage. The AC voltage has a duty ratio D of less than 50% on a peak value side opposite to a peak value that causes the toner in the contact portion to move from the image holding member or the intermediate transfer body toward the contact portion-forming member. The DC voltage causes the electric potential of the contact portion-forming member to be shifted to a side opposite to the charge polarity of the toner such that the absolute value of the electric potential of the contact portion-forming member is larger than the absolute value of the electric potential of the image holding member or the intermediate transfer body.

The contact portion-forming member of the specific transfer unit is a member that contacts with a surface (i.e., an image holding surface) of the image holding member or the intermediate transfer body and forms the contact portion between the contact portion-forming member and the surface of the image holding member or the intermediate transfer body.

When a recording medium passes through the contact portion, a toner image formed on the surface (i.e., the image holding surface) of the image holding member or the intermediate transfer body is transferred onto a surface of the recording medium through a transfer electric field generated in the contact portion by the transfer bias.

The transfer bias application unit in the specific transfer unit corresponds to the bias power source for applying the superimposed voltage.

The transfer bias used in the specific transfer unit will be described specifically.

The transfer bias used in the specific transfer unit has two peak values and includes the superimposed voltage composed of the AC voltage and the DC voltage. The AC voltage has a duty ratio D of less than 50% on a peak value side opposite to a peak value that causes the toner in the contact portion to move from the image holding member or the intermediate transfer body toward the contact portion-forming member. The DC voltage causes the electric potential of the contact portion-forming member to be shifted to a side opposite to the charge polarity of the toner such that the absolute value of the electric potential of the contact portion-forming member is larger than the absolute value of the electric potential of the image holding member or the intermediate transfer body.

The duty ratio D is determined from the following formula (1).

$$\text{Duty ratio } D[\%]=(T-Tt)/T\times 100 \quad (1)$$

Here, T is the time of one cycle of the AC voltage having two peaks in the transfer bias, and Tt is the time during which the electric potential of the AC voltage within one cycle is on the side, with respect to a center electric potential, toward a peak value that causes the toner in the contact portion to move from the image holding member or the intermediate transfer body toward the contact portion-forming member.

From the viewpoint of preventing the occurrence of a gradation pattern corresponding to surface irregularities of a recording medium, the duty ratio D determined from formula (1) above is preferably 40% or less and more preferably 35% or less.

The lower limit of the duty ratio D is, for example, 10% or more.

The transfer bias in the second transfer in the image forming apparatus shown in FIG. 1 will be specifically described.

Figure 2:
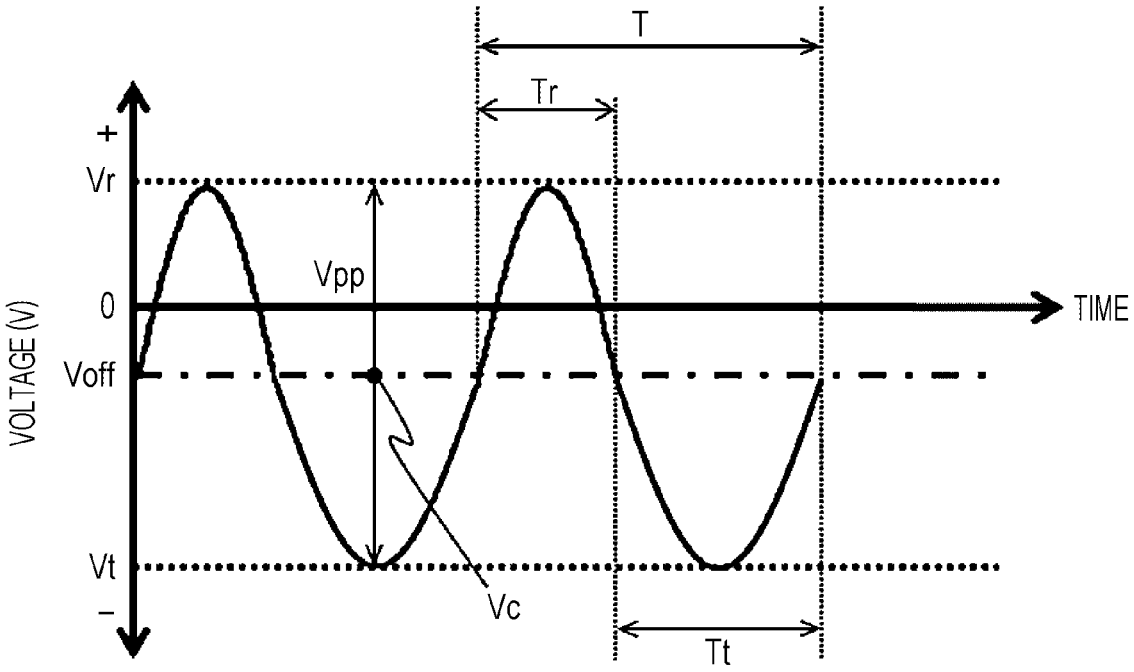
FIG. 2 is an illustration showing a transfer bias including a superimposed voltage composed of a DC voltage and an AC voltage in the exemplary embodiment.

The transfer bias used for the second transfer in the image forming apparatus shown in FIG. 1 has, for example, a waveform shown in FIG. 2. FIG. 2 is an illustration showing the transfer bias including a superimposed voltage composed of a DC voltage and an AC voltage and shows an example in which the duty ratio D is 40%.

In FIG. 2, a waveform indicated by a solid line represents the AC voltage (referred to also as an AC component), and a straight line indicated by a dash-dot line represents the DC voltage (referred to also as a DC component).

"Voff," "Vc," "Vr," "Vt," "T," "Tr," and "Tt" in FIG. 2 are as follows.

Voff is the electric potential of the DC voltage in the transfer bias. In the example shown in FIG. 2, the polarity of Voff is negative.

Vc is the center electric potential of the difference between the two peak values (the peak-to-peak value, Vpp in FIG. 2) of the AC voltage in the transfer bias.

Vt is a peak value on the side on which the toner in the contact portion is electrostatically moved from the image holding member or the intermediate transfer body toward the contact portion-forming member (this peak value is hereinafter referred to as a transfer peak value).

Vr is a peak value opposite to the peak value on the side on which the toner in the contact portion is electrostatically moved from the image holding member or the intermediate transfer body toward the contact portion-forming member (this peak value is hereinafter referred to as a reverse transfer peak value).

T is the time of one cycle of the AC voltage (which may be hereinafter referred to also as a cycle period).

Tr is the time, within one cycle (T in FIG. 2) of the AC voltage, from when the electric potential of the AC voltage starts rising from the center electric potential Vc toward the reverse transfer peak value Vr to when the electric potential returns to the center electric potential Vc through the reverse transfer peak value Vr (this time may be hereinafter referred to also as reverse transfer peak-side time).

Tt is the time, within one cycle (T in FIG. 2) of the AC voltage, from when the electric potential of the AC voltage starts rising from the center electric potential Vt toward the transfer peak value Vt to when the electric potential returns to the central electric potential Vt through the transfer peak value Vt (this time may be hereinafter referred to also as transfer peak-side time). The above-described Tt corresponds to "Tt" in formula (1) above, i.e., the time during which the electric potential of the AC voltage within one cycle T is on the side, with respect to the center electric potential, toward the peak value that causes the toner in the contact portion to move from the image holding member or the intermediate transfer body toward the contact portion-forming member.

Therefore, the duty ratio D can be said to be the ratio of the reverse transfer peak-side time Tr to the cycle period T.

In the second transfer in the image forming apparatus shown in FIG. 1, the second transfer roller 26 in contact with the surface (i.e., the image holding surface) of the intermediate transfer belt 20 corresponds to the contact portion-forming member, and the bias power source (not shown) connected to the support roller 24 corresponds to the transfer bias application unit.

The second transfer roller 26 is grounded. The transfer bias (i.e., the second transfer bias) is applied to the support roller 24 from the bias power source (not shown), and the transfer electric field is generated in the contact portion between the second transfer roller 26 and the intermediate transfer belt 20.

In the second transfer in the image forming apparatus shown in FIG. 1, the transfer bias is applied to the support roller 24. When the polarity of the second transfer bias is the same as the charge polarity (−) of the toner (i.e., is negative), the toner in the contact portion electrostatically moves in a transfer direction. When the polarity of the second transfer bias is opposite to the charge polarity (−) of the toner (i.e., is positive), the toner in the contact portion electrostatically moves in a direction opposite to the transfer direction. Specifically, when the transfer bias applied has the same polarity as the charge polarity of the toner, the toner sandwiched between the surface of the intermediate transfer belt 20 and the surface of the recording medium within the contact portion electrostatically moves from the intermediate transfer belt 20 side to the recording medium side. When the polarity of the transfer bias applied is opposite to the charge polarity of the toner, the toner electrostatically moves from the recording medium side to the intermediate transfer belt 20 side.

With the transfer bias described above, since the polarity of the AC voltage is changed, the toner moves back and forth between the intermediate transfer belt 20 side and the recording medium side. During the back and forth motion, the toner gradually moves from the intermediate transfer belt 20 side toward the recording medium (i.e., the toner image is transferred onto the surface of the recording medium). In particular, in the transfer bias described above, the duty ratio D is less than 50%. Therefore, the reverse transfer peak-side time is short, and the transfer peak-side time is long. Specifically, with the transfer bias described above, the time of the electrostatic movement of the toner in the transfer direction is longer than the time of the electrostatic movement of the toner in the direction opposite to the transfer direction. Moreover, in the transfer bias described above, the DC voltage causes the electric potential of the second transfer roller 26 to be shifted to the side opposite to the charge polarity (−) of the toner (i.e., the positive polarity side) such that the absolute value of the electric potential of the second transfer roller 26 is larger than the absolute value of the electric potential of the support roller 24. Specifically, with the transfer bias described above, since the toner is attracted toward the second transfer roller 26, the toner electrostatically moves easily in the transfer direction.

With the transfer bias described above, the toner continuously moves back and forth, and the toner image is thereby transferred efficiently. Therefore, the toner enters recessed portions sufficiently, and this may prevent the occurrence of a gradation pattern corresponding to surface irregularities.

The waveform of the AC voltage in the transfer bias is not limited to the waveform shown in FIG. 2, and the AC voltage may be a triangular wave or a rectangular wave.

In the example described above, the image forming apparatus shown in FIG. 1 is used. In this case, the second transfer roller 26 is grounded, and the transfer bias (i.e., the second transfer bias) is applied to the support roller 24. However, the present exemplary embodiment is not limited to this example. For example, the transfer bias (i.e., the second transfer bias) may applied to the second transfer roller 26, and the support roller 24 may be grounded. In this case, the polarity of the DC voltage is changed.

More specifically, in the above example, the charge polarity of the toner is negative. In this case, when the second transfer roller 26 is grounded and the transfer bias (i.e., the second transfer bias) is applied to the support roller 24, the polarity of the DC voltage used is the same as the charge polarity of the toner and is negative. When the transfer bias (i.e., the second transfer bias) is applied to the second transfer roller 26 and the support roller 24 is grounded, the polarity of the DC voltage used is opposite to the charge polarity of the toner and is positive.

Alternatively, instead of applying the transfer bias (i.e., the second transfer bias) to the second transfer roller 26 or the support roller 24, the DC voltage may be applied to one of the second transfer roller 26 and the support roller 24, and the AC voltage may be applied to the other one to which the DC voltage is not applied.

When an image is formed on a recording medium with less surface irregularities (a recording medium with high surface smoothness), the transfer bias (i.e., the second transfer bias) is unnecessary. Therefore, the transfer bias may be changed according to the type of recording medium used for image formation. For example, when an image is formed on a recording medium with less surface irregularities, only a DC voltage may be used as the second transfer bias, or a superimposed voltage composed of a DC voltage and an AC voltage with a sinusoidal waveform may be used.

The transfer bias may be changed by a controller (corresponding to the controller 32 in FIG. 1) of the image forming apparatus.

(Pressure Changing Mechanism)

From the viewpoint of effectively preventing the occurrence of a gradation pattern corresponding to surface irregularities of a recording medium, the specific transfer unit in the present exemplary embodiment may further include a mechanism capable of changing the pressure applied to the contact portion between the contact portion-forming member and the image holding member or the intermediate transfer body (this mechanism is referred to as a pressure changing mechanism).

More specifically, the specific transfer unit may include a mechanism that can change the pressure acting on the contact portion between the contact portion-forming member and the image holding member or the intermediate transfer body. This mechanism reduces the pressure acting on the contact portion when a toner image is transferred onto a recording medium with less surface irregularities (i.e., a recording medium with high surface smoothness) and increases the pressure acting on the contact portion when a toner image is transferred onto a recording medium with large surface irregularities.

Therefore, the specific transfer unit may include an information acquisition unit that acquires information about the surface flatness of a recording medium, and the pressure changing mechanism may adjust the pressure acting on the contact portion according to the information from the information acquisition unit.

When a toner image is transferred onto a recording medium with large surface irregularities, the pressure acting on the contact portion is applied even to recessed portions sufficiently by increasing the pressure acting on the contact portion, so that good transfer performance is obtained.

By adjusting the pressure acting on the contact portion according to the surface smoothness of the recording medium, stable transfer performance is obtained irrespective of the degree of the surface smoothness of the recording medium.

An example of the pressure changing mechanism included in the specific transfer unit will be described.

Figure 3:
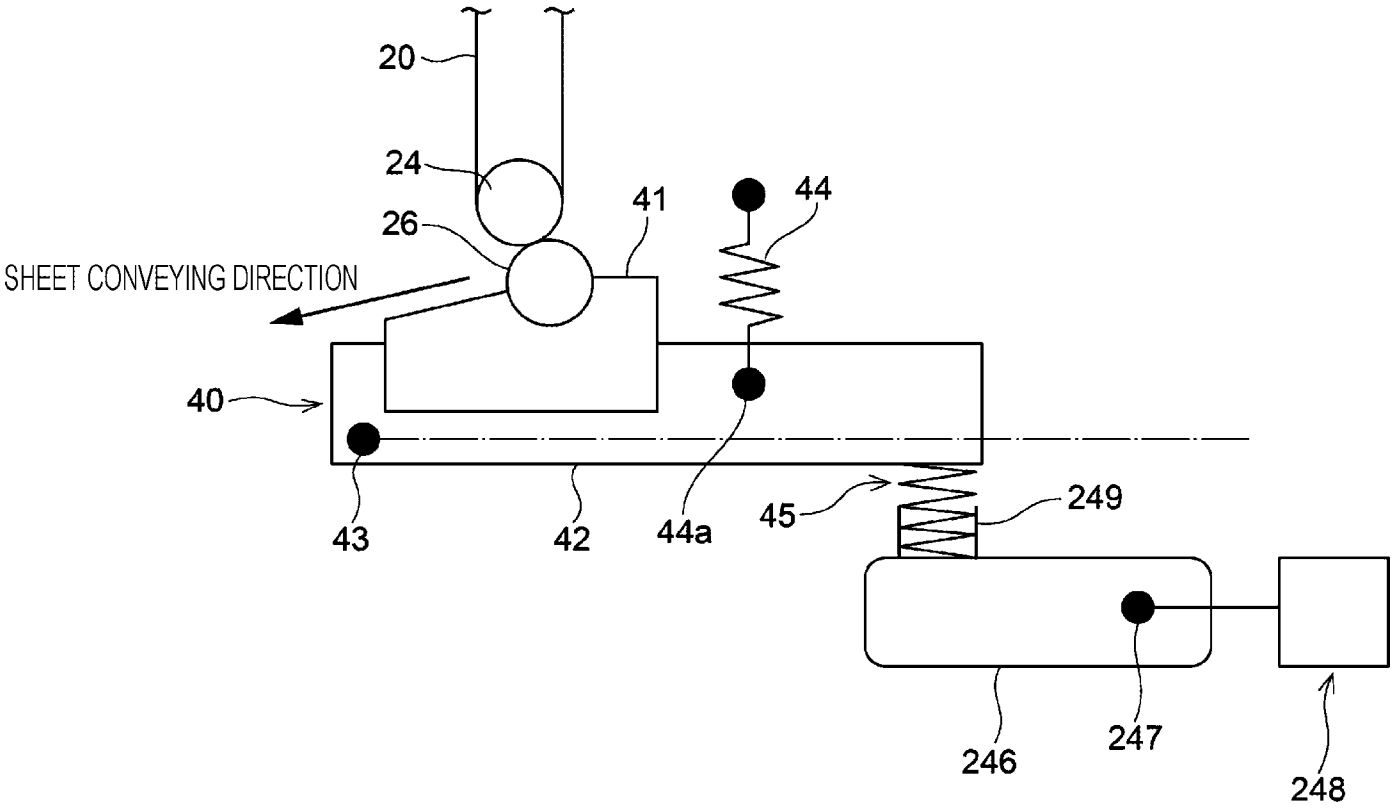
FIG. 3 is a schematic illustration showing the structure of a mechanism capable of changing the pressure acting on a contact portion of a transfer unit.

FIG. 3 is a schematic illustration showing the structure of a pressure changing device 40 disposed in the second transfer roller 26 of the image forming apparatus shown in FIG. 1.

The pressure changing device 40 changes the pressure acting on the contact portion between the second transfer roller 26 and the support roller 24 by changing a force for pressing the second transfer roller 26 against the support roller 24.

The pressure changing device 40 includes a pressurizing plate 42 that holds a second transfer unit 41 rotatably supporting opposite ends of the rotating shaft of the second transfer roller 26. The pressurizing plate 42 is rotatable about a pressurizing plate rotating shaft 43 parallel to the rotating shaft of the second transfer roller 26.

The pressurizing plate 42 receives the urging forces of a tension spring 44 and a compression spring 45, which are spring members used as elastic members. The urging forces act on the side on which the second transfer roller 26 is disposed (on the right side of the pressurizing plate rotating shaft 43 in FIG. 3), and a rotational force about the pressurizing plate rotating shaft 43 is thereby generated. The rotational force causes the second transfer roller 26 to contact with the intermediate transfer belt 20, and a pressure is thereby generated in the contact portion between the second transfer roller 26 and the intermediate transfer belt 20.

The tension spring 44, which is a first pressurizing unit, is disposed so as to pull the pressurizing plate 42 upward, and an urging force thereby acts on the pressurizing plate 42. The compression spring 45, which is a second pressurizing unit, is disposed so as to press the pressurizing plate 42 upward from the lower side, and the lower end position of the compression spring 45 is vertically movable according to the rotation angle of two pressurizing arms 246. Each pressurizing arm 246 is driven to rotate about a pressurizing arm rotating shaft 247 by a rotation driving source 248. The rotation driving source 248 is controlled by a controller (not shown), and the rotation angle position at which the pressurizing arms 246 stop can thereby be changed.

In the pressure changing device 40, the urging forces of the pair of the tension spring 44 and the compression spring 45 disposed on a first side of the second transfer roller 26 are used to change the pressing force acting on the first side of the second transfer roller 26. A pressurizing stay 249 is attached to the lower end of the compression spring 45. When the pressurizing arms 246 press the pressurizing stay 249 upward, the urging force of the compression spring 45 acts on the pressurizing plate 42.

Figure 4:
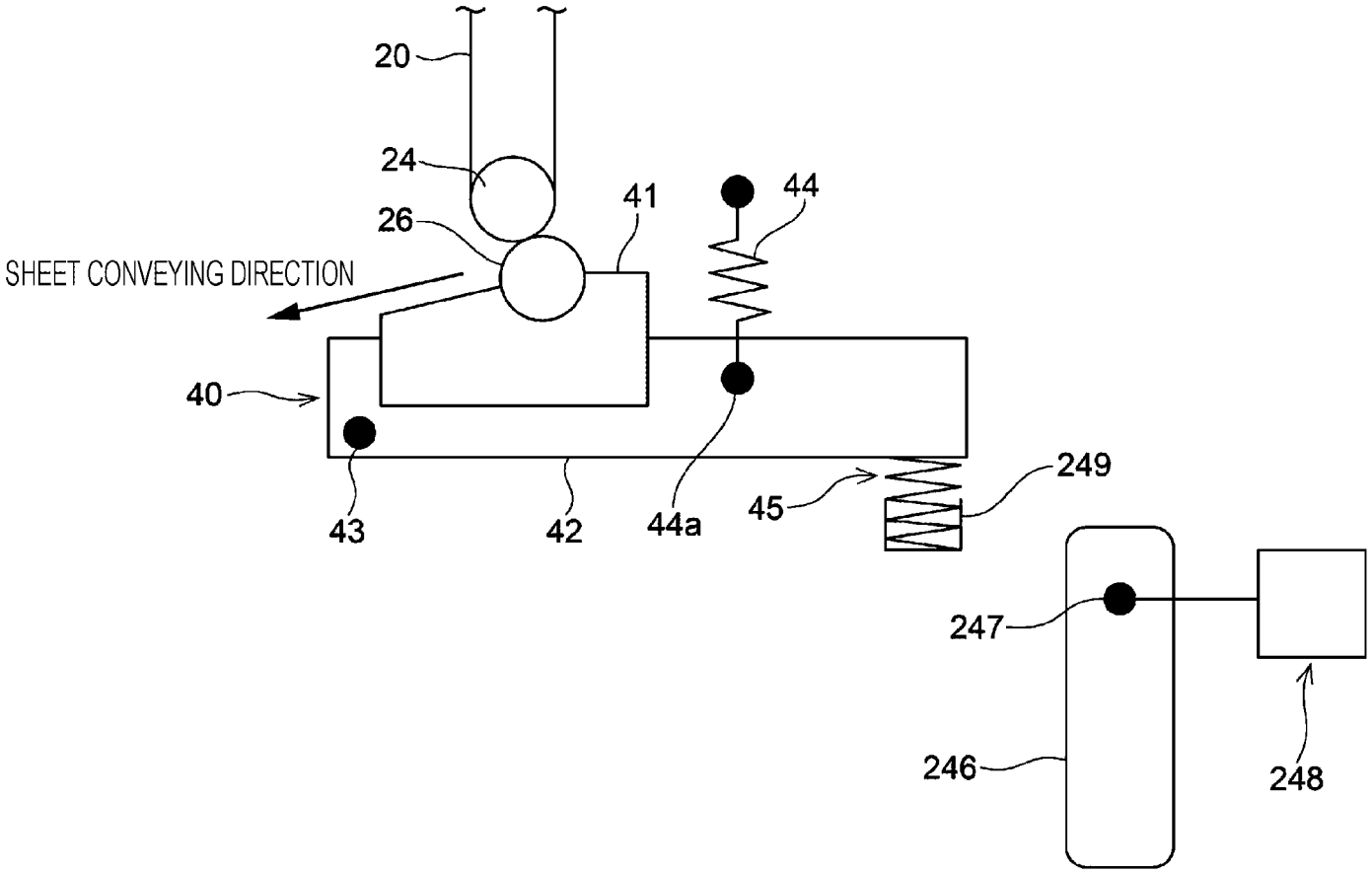
FIG. 4 is a schematic illustration showing the structure of the mechanism capable of changing the pressure acting on the contact portion of the transfer unit.

In the pressure changing device 40, when the pressurizing arms 246 are stopped at a rotation angle position (second rotation angle) shown in FIG. 4 and are in a rest state, the pressurizing arms 246 are separated from the pressurizing stay 249 attached to the lower end of the compression spring 45, and the amount of compression of the compression spring 45 is zero (the length of the compression spring 45 is equal to its natural length). In this case, since no urging force of the compression spring 45 acts on the pressurizing plate 42, only the urging force of the tension spring 44 acts on the first side.

In a compression spring-pressurized state in which the pressurizing arms 246 are stopped at a rotation angle position (first rotation angle) shown in FIG. 3, the pressurizing arms 246 push upward the pressurizing stay 249 attached to the lower end of the compression spring 45. The compression spring 45 is thereby compressed, and the urging force of the compression spring 45 acts on the pressurizing plate 42. In this case, the urging force of the compression spring 45 causes a pressing force to act on the pressurizing plate 42. Therefore, the pressing force acting on the first side of the second transfer roller 26 is the sum of the urging force of the tension spring 44 and the urging force of the compression spring 45.

With the pressure changing device 40, when an image is formed on a recording paper sheet P with large surface irregularities (i.e., a recording medium with low surface smoothness) such as embossed paper, the rotation angle of the two pressurizing arms 246 arranged in the width direction of the second transfer roller 26 is set to the first rotation angle shown in FIG. 3. The second transfer roller 26 thereby comes into contact with the intermediate transfer belt 20 with a high pressing force, and the pressure is applied even to recessed portions of the irregular recording medium sufficiently, so that good transfer performance is obtained.

With the pressure changing device 40, when an image is formed on a recording paper sheet P with less surface irregularities (i.e., a recording medium with high surface smoothness) such as coated paper, the rotation angle of the two pressurizing arms 246 is set to the second rotation angle shown in FIG. 4. In this case, the second transfer roller 26 is in contact with the intermediate transfer belt 20 with a low pressing force, so that sufficient transfer performance is obtained.

[Intermediate Transfer Body]

The image forming apparatus according to the present exemplary embodiment may be an intermediate transfer-type image forming apparatus. In this case, from the viewpoint of effectively preventing the occurrence of a gradation pattern corresponding to surface irregularities of a recording medium, the intermediate transfer body may have an elastic layer.

No particular limitation is imposed on the shape of the intermediate transfer body, and the intermediate transfer body may be, for example, an endless belt-shaped member or a roller-shaped member. In the following description, the structure of an endless belt member (i.e., the intermediate transfer belt) will be described as an example.

The intermediate transfer belt may be, for example, a belt member having a stacked structure including an elastic layer forming an outer circumferential surface and a substrate disposed on the inner circumferential side of the elastic layer.

The elastic layer and the substrate may be disposed so as to be in direct contact with each other at their interface or may be disposed with another layer such as a bonding layer interposed therebetween.

The intermediate transfer belt may be a belt member having a single layer structure including only the elastic layer.

(Elastic Layer)

The elastic layer is configured to contain a material with high elasticity (i.e., an elastic material) and preferably contains a rubber material.

From the viewpoint of controlling hardness, the elastic layer may contain a filler. From the viewpoint of imparting electrical conductivity, the elastic layer may contain a conducting agent. The elastic layer may further contain well-known additional additives other than the filler and the conducting agent.

—Elastic Material—

Examples of the elastic material used for the elastic layer include rubber materials such as acrylic rubber (such as acrylonitrile-butadiene copolymer rubber (NBR) and acrylonitrile-butadiene rubber), urethane rubber, ethylene-propylene-diene copolymer rubber (EPDM), epichlorohydrin rubber (ECO), chloroprene rubber (CR), styrene-butadiene copolymer rubber (SBR), chlorinated polyisoprene rubber, isoprene rubber, hydrogenated polybutadiene rubber, butyl rubber, silicone rubber, and fluorocarbon rubber. In addition to the rubber materials, resins such as polyurethane, polyethylene, polyamide, and polypropylene may be used. Any one of these elastic materials may be used alone or in combination of two or more for the elastic layer.

—Filler—

The filler may be an organic filler or an inorganic filler.

Examples of the organic filler include: thermosetting resin particles such as melamine resin particles, phenolic resin particles, epoxy resin particles, urea resin particles, unsaturated polyester resin particles, alkyd resin particles, polyurethane particles, curable polyimide particles, and silicone resin particles; and thermoplastic resin particles such as vinyl chloride resin particles, polyethylene particles, polypropylene particles, polystyrene particles, polyvinyl acetate particles, TEFLON (registered trademark) particles, ABS resin particles, and acrylic resin particles.

Examples of the inorganic filler include inorganic particles of carbonaceous materials (such as carbon black, carbon fibers, and carbon nanotubes), titanium oxide, silicon carbide, talc, mica, kaolin, iron oxide, calcium carbonate, calcium silicate, magnesium oxide, graphite, silicon nitride, boron nitride, iron oxide, cerium oxide, aluminum oxide, magnesium carbonate, and metallic silicon.

The content of the filler in the elastic layer may be determined according to the intended hardness of the elastic layer and is, for example, preferably from 0.1% by mass to 50% by mass inclusive and more preferably from 0.2% by mass to 40% by mass inclusive based on the total mass of the elastic layer.

Any of these fillers may be used alone or in combination of two or more.

—Conducting Agent—

Examples of the conducting agent include electrically conductive particles (e.g., resistivity: less than $10^7$ Ω·cm) and semiconductive particles (e.g., resistivity: from $10^7$ Ω·cm to $10^{13}$ Ω·cm inclusive).

No particular limitation is imposed on the conducting agent. Examples of the conducting agent include: carbonaceous materials such as carbon black (such as Ketjen black, acetylene black, and carbon black subjected to surface oxidation treatment), carbon fibers, carbon nanotubes, and graphite; metals and alloys (such as aluminum, nickel, copper, and silver); metal oxides (such as yttrium oxide, tin oxide, indium oxide, antimony oxide, and $SnO_2$—$In_2O_3$ complex oxide); and ionic conductive materials (such as potassium titanate and LiCl).

A suitable conducting agent is selected according to the intended application, and carbon black may be used. In particular, from the viewpoint of long-term stability of electric resistance and electric field dependence for preventing electric field concentration due to the transfer voltage, the conducting agent may be carbon black subjected to oxidation treatment at a pH of 5 or less (preferably a pH of 4.5 or less and more preferably a pH of 4.0 or less) (e.g., carbon black with carboxyl groups, quinone groups, lactone groups, or hydroxyl groups disposed on its surface).

The content of the conducting agent in the elastic layer is determined according to the intended resistance and is, for example, preferably from 20% by mass to 35% by mass inclusive and more preferably from 25% by mass to 30% by mass inclusive based on the total mass of the elastic layer.

Any of these conducting agents may be used alone or in combination of two or more.

—Additional Additives—

Examples of the additional additives other than the filler and the conducting agent include: a dispersant for improving the dispersibility of the filler and the conducting agent (such as carbon black); a catalyst; a leveling agent for improving the quality of films; and releasing materials (e.g., particles of fluororesins such as polytetrafluoroethylene (PTFE), tetrafluoroethylene-perfluoroalkyl vinyl ether copolymers (PFA), and tetrafluoroethylene-hexafluoropropylene copolymers (FEP)) for improving releasability.

—Thickness of Elastic Layer—

When the intermediate transfer body is an intermediate transfer belt having a single layer structure including only the elastic layer, the thickness (average thickness) of the elastic layer is preferably from 200 μm to 5,000 μm inclusive, more preferably from 300 μm to 4,000 μm inclusive, and still more preferably from 400 μm to 2,000 μm inclusive.

When the thickness of the elastic layer (i.e., the intermediate transfer belt) is within the above range, the efficiency of transferring a toner image onto the surface of a recording medium can be easily increased, and the driving force transmissibility of the intermediate transfer belt can be easily increased.

When the intermediate transfer body is an intermediate transfer belt having a stacked structure including the elastic layer and a substrate on the inner circumferential side of the elastic layer, the thickness (average thickness) of the elastic layer is preferably from 100 μm to 2,000 μm inclusive, more preferably from 150 μm to 1,500 μm inclusive, and still more preferably from 200 μm to 1,000 μm inclusive.

When the thickness of the elastic layer is within the above range, the efficiency of transferring a toner image onto the surface of a recording medium can be easily increased.

The thicknesses of layers forming the intermediate transfer body are measured using an eddy current coating thickness meter CTR-1500E manufactured by SANKO ELECTRONIC LABORATORY CO., LTD. In the present exemplary embodiment, the measurement is performed at 12 points (3 points at regular intervals in the axial direction of the intermediate transfer body and 4 points at regular intervals in the circumferential direction of the intermediate transfer body), and the average of the measured thicknesses is used as the average thickness.

When the intermediate transfer body is an intermediate transfer belt, the axial direction of the intermediate transfer body is the axial direction of rollers around which the intermediate transfer belt is wound with tension applied to the rollers. When the intermediate transfer body is an intermediate transfer roller, the axial direction is the axial direction of the roller.

(Substrate)

The substrate disposed on the inner circumferential side of the elastic layer may be configured to include a resin material. From the viewpoint of imparting electrical conductivity, the substrate may contain a conducting agent and may further contain well-known additional additives.

—Resin Material—

Examples of the resin material used for the substrate include polyimide resins, fluorinated polyimide resins, polyamide resins, polyamide-imide resins, polyether ester resins, polyarylate resins, and polyester resins. Any of these resin materials may be used alone or in combination of two or more for the substrate.

In particular, from the viewpoint of increasing the stiffness of the inner circumferential surface to obtain resistance to deformation when the intermediate transfer belt is wound around the rollers with tension applied to the belt, it is more preferable to use at least one of a polyimide resin and a polyamide-imide resin.

—Additional Additives—

In addition to the resin material, a filler, a conducting agent, and additional additives may be added to the substrate.

Examples of the filler, the conducting agent, and the additional additives include those described for the filler, the conducting agent, and the additional additives for the elastic layer.

—Thickness of Substrate—

When the intermediate transfer body is an intermediate transfer belt having a stacked structure including the elastic layer and the substrate disposed on the inner circumferential side thereof, the thickness (average thickness) of the substrate is preferably from 10 μm to 1,000 μm inclusive, more preferably from 30 μm to 600 μm inclusive, and still more preferably from 50 μm to 400 μm inclusive.

When the thickness of the substrate forming the inner circumferential surface is within the above range, a change in tension caused by the elongation of the belt wound around the rollers and driven to rotate is easily prevented, and the intermediate transfer belt has high driving force transmissibility.

(Bonding Layer)

When the intermediate transfer body is an intermediate transfer belt having a stacked structure including the elastic layer and the substrate disposed on the inner circumferential side thereof, the intermediate transfer belt may have a bonding layer between the elastic layer and the substrate.

No particular limitation is imposed on the adhesive used for the bonding layer, and a well-known adhesive may be used. Examples of the adhesive include silane coupling agents, silicone-based adhesives, and urethane-based adhesives.

The thickness (average thickness) of the intermediate transfer belt is preferably from 0.05 mm to 0.5 mm inclusive, more preferably from 0.06 mm to 0.30 mm inclusive, and still more preferably from 0.06 mm to 0.15 mm inclusive.

[Recording Medium]

The recording medium (e.g., the recording paper sheet P in FIG. 1) onto which a toner image is transferred may be, for example, a plain paper sheet used for electrophotographic copiers, printers, etc. or a transparency and may be a coated paper sheet obtained by coating the surface of a plain paper sheet with, for example, a resin, an art paper sheet for printing, etc.

The image forming apparatus according to the present exemplary embodiment includes: the developing unit that houses the developer containing the specific toner; and the second transfer unit that uses the specific second transfer bias. Therefore, Japanese paper, rough paper, embossed paper, etc. with large surface irregularities can be easily used as the recording medium. Specifically, even when a recording medium with large surface irregularities is used, a gradation pattern corresponding to surface irregularities tends not to occur, and an image with high image quality can be obtained.

In the example described above, the image forming apparatus according to the present exemplary embodiment is a second transfer-type image forming apparatus, but this is not a limitation.

For example, in a direct transfer-type image forming apparatus, the contact portion-forming member of the specific transfer unit corresponds to a transfer member such as a transfer roller in contact with the surface of the image holding member, and the transfer bias is applied to the transfer member.

EXAMPLES

Examples of the present disclosure will next be described. However, the present disclosure is not limited to these Examples. In the following description, "parts" and "%" are based on mass, unless otherwise specified.

The viscosity and maximum endothermic peak temperature of a toner and its absorbances at different wavenumbers are measured by the methods described above.

(Developers A1 to A13 and B1 to B3)

—Preparation of Styrene-Acrylic Resin Particle Dispersions—

<Production of Resin Particle Dispersion (1)>

Styrene: 200 parts
n-Butyl acrylate: 50 parts
Acrylic acid: 1 part
β-Carboxyethyl acrylate: 3 parts
Propanediol diacrylate: 1 part
2-Hydroxyethyl acrylate: 0.5 parts
Dodecanethiol: 1 part A flask is charged with a solution prepared by dissolving 4 parts of an anionic surfactant (DOWFAX manufactured by Dow Chemical Company) in 550 parts of ion exchanged water, and a solution mixture prepared by mixing the above raw materials is added to the solution and emulsified. While the emulsion is gently stirred for 10 minutes, 50 parts of ion exchanged water containing 6 parts of ammonium persulfate dissolved therein is added to the emulsion. Next, the system is purged with nitrogen sufficiently and heated to 75° C. using an oil bath to allow polymerization to proceed for 30 minutes.

Styrene: 110 parts
n-Butyl acrylate: 50 parts
β-Carboxyethyl acrylate: 5 parts
1,10-Decanediol diacrylate: 2.5 parts
Dodecanethiol: 2 parts Next, a solution mixture prepared by mixing the above raw materials is emulsified, and the emulsion is added to the flask over 120 minutes. Then emulsion polymerization is continued for 4 hours. A resin particle dispersion containing dispersed therein resin particles with a weight average molecular weight of 32,000, a glass transition temperature of 53° C., and a volume average particle diameter of 240 nm is thereby obtained. Ion exchanged water is added to the resin particle dispersion to adjust the solid content to 20% by mass, and the resulting dispersion is used as a resin particle dispersion (1).

<Production of Resin Particle Dispersion (2)>

Styrene: 200 parts
n-Butyl acrylate: 50 parts
Acrylic acid: 1 part
β-Carboxyethyl acrylate: 3 parts
Propanediol diacrylate: 1 part
2-Hydroxyethyl acrylate: 0.5 parts
Dodecanethiol: 1.5 parts A flask is charged with a solution prepared by dissolving 4 parts of an anionic surfactant (DOWFAX manufactured by Dow Chemical Company) in 550 parts of ion exchanged water, and a solution mixture prepared by mixing the above raw materials is added to the solution and emulsified. While the emulsion is gently stirred for 10 minutes, 50 parts of ion exchanged water containing 6 parts of ammonium persulfate dissolved therein is added to the emulsion. Next, the system is purged with nitrogen sufficiently and heated to 75° C. using an oil bath to allow polymerization to proceed for 30 minutes.

Styrene: 110 parts
n-Butyl acrylate: 50 parts
β-Carboxyethyl acrylate: 5 parts
1,10-Decanediol diacrylate: 2.5 parts
Dodecanethiol: 2.5 parts Next, a solution mixture prepared by mixing the above raw materials is emulsified, and the emulsion is added to the flask over 120 minutes. Then emulsion polymerization is continued for 4 hours. A resin particle dispersion containing dispersed therein resin particles with a weight average molecular weight of 30,000, a glass transition temperature of 53° C., and a volume average particle diameter of 220 nm is thereby obtained. Ion exchanged water is added to the resin particle dispersion to adjust the solid content to 20% by mass, and the resulting dispersion is used as a resin particle dispersion (2).

<Production of Resin Particle Dispersion (3)>

Styrene: 200 parts
n-Butyl acrylate: 50 parts
Acrylic acid: 1 part
β-Carboxyethyl acrylate: 3 parts
Propanediol diacrylate: 1 part
2-Hydroxyethyl acrylate: 0.5 parts
Dodecanethiol: 1.5 parts A flask is charged with a solution prepared by dissolving 4 parts of an anionic surfactant (DOWFAX manufactured by Dow Chemical Company) in 550 parts of ion exchanged water, and a solution mixture prepared by mixing the above raw materials is added to the solution and emulsified. While the emulsion is gently stirred for 10 minutes, 50 parts of ion exchanged water containing 7 parts of ammonium persulfate dissolved therein is added to the emulsion. Next, the system is purged with nitrogen sufficiently and heated to 80° C. using an oil bath to allow polymerization to proceed for 30 minutes.

Styrene: 110 parts
n-Butyl acrylate: 50 parts
β-Carboxyethyl acrylate: 5 parts
1,10-Decanediol diacrylate: 2.5 parts
Dodecanethiol: 3.0 parts Next, a solution mixture prepared by mixing the above raw materials is emulsified, and the emulsion is added to the flask over 120 minutes. Then emulsion polymerization is continued for 4 hours. A resin particle dispersion containing dispersed therein resin particles with a weight average molecular weight of 28,000, a glass transition temperature of 53° C., and a volume average particle diameter of 230 nm is thereby obtained. Ion exchanged water is added to the resin particle dispersion to adjust the solid content to 20% by mass, and the resulting dispersion is used as a resin particle dispersion (3).

<Production of Resin Particle Dispersion (4)>

Styrene: 200 parts
n-Butyl acrylate: 50 parts
Acrylic acid: 1 part
β-Carboxyethyl acrylate: 3 parts
Propanediol diacrylate: 1 part
2-Hydroxyethyl acrylate: 0.5 parts
Dodecanethiol: 2.0 parts A flask is charged with a solution prepared by dissolving 4 parts of an anionic surfactant (DOWFAX manufactured by Dow Chemical Company) in 550 parts of ion exchanged water, and a solution mixture prepared by mixing the above raw materials is added to the solution and emulsified. While the emulsion is gently stirred for 10 minutes, 50 parts of ion exchanged water containing 7.5 parts of ammonium persulfate dissolved therein is added to the emulsion. Next, the system is purged with nitrogen sufficiently and heated to 85° C. using an oil bath to allow polymerization to proceed for 30 minutes.

Styrene: 110 parts
n-Butyl acrylate: 50 parts
β-Carboxyethyl acrylate: 5 parts
1,10-Decanediol diacrylate: 2.5 parts
Dodecanethiol: 3.5 parts Next, a solution mixture prepared by mixing the above raw materials is emulsified, and the emulsion is added to the flask over 120 minutes. Then emulsion polymerization is continued for 4 hours. A resin particle dispersion containing dispersed therein resin particles with a weight average molecular weight of 26,500, a glass transition temperature of 53° C., and a volume average particle diameter of 210 nm is thereby obtained. Ion exchanged water is added to the resin particle dispersion to adjust the solid content to 20% by mass, and the resulting dispersion is used as a resin particle dispersion (4).

<Production of Resin Particle Dispersion (5)>

Styrene: 200 parts
n-Butyl acrylate: 50 parts
Acrylic acid: 1 part
β-Carboxyethyl acrylate: 3 parts
Propanediol diacrylate: 1 part
2-Hydroxyethyl acrylate: 0.5 parts
Dodecanethiol: 0.8 parts A flask is charged with a solution prepared by dissolving 4 parts of an anionic surfactant (DOWFAX manufactured by Dow Chemical Company) in 550 parts of ion exchanged water, and a solution mixture prepared by mixing the above raw materials is added to the solution and emulsified. While the emulsion is gently stirred for 10 minutes, 50 parts of ion exchanged water containing 5.5 parts of ammonium persulfate dissolved therein is added to the emulsion. Next, the system is purged with nitrogen sufficiently and heated to 85° C. using an oil bath to allow polymerization to proceed for 30 minutes.

Styrene: 110 parts
n-Butyl acrylate: 50 parts
β-Carboxyethyl acrylate: 5 parts
1,10-Decanediol diacrylate: 2.5 parts
Dodecanethiol: 1.7 parts Next, a solution mixture prepared by mixing the above raw materials is emulsified, and the emulsion is added to the flask over 120 minutes. Then emulsion polymerization is continued for 4 hours. A resin particle dispersion containing dispersed therein resin particles with a weight average molecular weight of 36,000, a glass transition temperature of 53° C., and a volume average particle diameter of 260 nm is thereby obtained. Ion exchanged water is added to the resin particle dispersion to adjust the solid content to 20% by mass, and the resulting dispersion is used as a resin particle dispersion (5).

<Preparation of Magenta Coloring Agent Particle Dispersion>

—C.I. Pigment Red 122: 50 parts

Anionic surfactant NEOGEN RK (manufactured by DAI-ICHI KOGYO SEIYAKU Co., Ltd.): 5 parts Ion exchanged water: 220 parts The above components are mixed and dispersed using ULTIMAIZER (manufactured by Sugino Machine Limited) at 240 MPa for 10 minutes to prepare a magenta coloring agent particle dispersion (solid concentration: 20%).

<Preparation of Release Agent Particle Dispersion (1)>

Ester wax (WEP-2 manufactured by NOF CORPORATION): 100 parts

Anionic surfactant (NEOGEN RK manufactured by DAI-ICHI KOGYO SEIYAKU Co., Ltd.): 2.5 parts Ion exchanged water: 250 parts The above materials are mixed, heated to 120° C., dispersed using a homogenizer (ULTRA-TURRAX T50 manufactured by IKA), and then subjected to dispersion treatment using a Manton-Gaulin high-pressure homogenizer (manufactured by Gaulin Corporation) to thereby obtain a release agent particle dispersion (1) (solid content: 29.1% by mass) containing dispersed therein release agent particles with a volume average particle diameter of 330 nm.

<Preparation of Release Agent Particle Dispersion (2)>

Fischer-Tropsch wax (manufactured by Nippon Seiro Co., Ltd.): 100 parts

Anionic surfactant (NEOGEN RK manufactured by DAI-ICHI KOGYO SEIYAKU Co., Ltd.): 2.5 parts Ion exchanged water: 250 parts The above materials are mixed, heated to 120° C., dispersed using a homogenizer (ULTRA-TURRAX T50 manufactured by IKA), and then subjected to dispersion treatment using a Manton-Gaulin high-pressure homogenizer (manufactured by Gaulin Corporation) to thereby obtain a release agent particle dispersion (2) (solid content: 29.2% by mass) containing dispersed therein release agent particles with a volume average particle diameter of 340 nm.

<Preparation of Release Agent Particle Dispersion (3)>

Paraffin wax (FNP0090 manufactured by Nippon Seiro Co., Ltd.): 100 parts

Anionic surfactant (NEOGEN RK manufactured by DAI-ICHI KOGYO SEIYAKU Co., Ltd.): 2.5 parts Ion exchanged water: 250 parts The above materials are mixed, heated to 120° C., dispersed using a homogenizer (ULTRA-TURRAX T50 manufactured by IKA), and then subjected to dispersion treatment using a Manton-Gaulin high-pressure homogenizer (manufactured by Gaulin Corporation) to thereby obtain a release agent particle dispersion (3) (solid content: 29.0% by mass) containing dispersed therein release agent particles with a volume average particle diameter of 360 nm.

<Preparation of Release Agent Particle Dispersion (4)>

Polyethylene wax (POLYWAX 725 manufactured by TOYO ADL CORPORATION): 100 parts

Anionic surfactant (NEOGEN RK manufactured by DAI-ICHI KOGYO SEIYAKU Co., Ltd.): 2.5 parts Ion exchanged water: 250 parts The above materials are mixed, heated to 100° C., dispersed using a homogenizer (ULTRA-TURRAX T50 manufactured by IKA), and then subjected to dispersion treatment using a Manton-Gaulin high-pressure homogenizer (manufactured by Gaulin Corporation) to thereby obtain a release agent particle dispersion (4) (solid content: 29.3% by mass) containing dispersed therein release agent particles with a volume average particle diameter of 370 nm.

<Production of Toner A1>

Ion exchanged water: 400 parts

Resin particle dispersion (1): 200 parts

Magenta coloring agent particle dispersion: 40 parts

Release agent particle dispersion (2): 12 parts

Release agent particle dispersion (3): 24 parts

The above components are placed in a reaction vessel equipped with a thermometer, a pH meter, and a stirrer and held at 30° C. and a stirring speed of 150 rpm for 30 minutes while the temperature of the mixture is controlled from the outside using a heating mantle.

While the mixture is dispersed using a homogenizer (ULTRA-TURRAX T50 manufactured by IKA Japan), an aqueous PAC solution prepared by dissolving 2.1 parts of aluminum polychloride (PAC manufactured by Oji Paper Co., Ltd.: 30% powder) in 100 parts of ion exchanged water is added to the mixture. Then the resulting mixture is heated to 50° C., and particle diameters are measured using COULTER MULTISIZER II (manufactured by Coulter: aperture diameter: 50 μm) to adjust the volume average particle diameter to 5.0 μm. Then 115 parts of the resin particle dispersion (1) is additionally added to cause the resin particles to adhere to the surface of the aggregated particles (to form a shell structure).

Next, 20 parts of a 10 mass % aqueous NTA (nitrilotriacetic acid) metal salt solution (CHELEST 70 manufactured by Chelest) is added, and the pH of the mixture is adjusted to 9.0 using a 1N aqueous sodium hydroxide solution. Then the resulting mixture is heated to 91° C. at a heating rate of 0.05° C./minute and held at 91° C. for 3 hours to thereby obtain a toner slurry. The toner slurry obtained is cooled to 85° C. and held for 1 hour. Then the slurry is cooled to 25° C., and a magenta toner is thereby obtained. The magenta toner is re-dispersed in ion exchanged water and filtrated. This procedure is repeated to wash the toner until the electric conductivity of the filtrate reaches 20 μS/cm or less, and the product is vacuum-dried in an oven at 40° C. for 5 hours to thereby obtain toner particles.

1.5 Parts of hydrophobic silica (RY50 manufactured by Nippon Aerosil Co., Ltd.) and 1.0 part of hydrophobic titanium oxide (T805 manufactured by Nippon Aerosil Co., Ltd.) are mixed with 100 parts of the obtained toner particles using a sample mill at 10,000 rpm for 30 seconds. Then the mixture is sieved using a vibrating sieve with a mesh size of 45 μm to prepare a toner A1. The toner A1 has a volume average particle diameter of 5.7 μm.

<Production of Developer A1>

8 Parts of the toner A1 and 92 parts of a carrier are mixed using a V blender to produce a developer A1 (Electrostatic Image Developer A1).

<Production of Developers A2 to A13, B1, and B2>

Magenta toners A2 to A13, B1, and B2 are obtained in the same manner as that for the toner A1 except that the resin particle dispersion used, the release agent particle dispersions used, the amount of the flocculant, coalescence temperature, holding temperature, and holding time are changed as shown in Table 1.

Electrostatic image developers A2 to A13, B1, and B2 are produced in the same manner as that for the developer A1 except that the toners obtained are used.

<Production of Developer B3>

A magenta toner B3 is obtained in the same manner as that for the toner A1 except that the resin particle dispersion used, the release agent particle dispersions used, the amount of the flocculant, coalescence temperature, holding temperature, and holding time are changed as shown in Table 1.

An electrostatic image developer B3 is produced in the same manner as that for the developer A1 except that the toner obtained is used.

(Production of Intermediate Transfer Belts C1 and C2)

An acrylic rubber layer (thickness: 150 μm) containing dispersed therein melamine particles with an average particle diameter of 1.5 μm is stacked on a substrate (thickness: 80 μm) composed of a polyimide resin layer to thereby produce an intermediate transfer belt C1.

An intermediate transfer belt C2 composed only of the polyimide resin layer (thickness: 80 μm) is also produced.

Examples 1 to 32 and Comparative Examples 1 to 6

A commercial electrophotographic copier (DOCU CENTRE COLOR 450 manufactured by Fuji Xerox Co., Ltd.), which is a second transfer-type image forming apparatus using an intermediate transfer belt, is prepared. One of the intermediate transfer belts shown in Tables 2 to 4 is placed in the electrophotographic copier, and the pressure changing mechanism shown in FIGS. 3 and 4 is placed in the copier. Then one of the developers shown in Tables 2 to 4 is placed in a developing device of the copier.

TABLE 1

| Toner | (Inη (T1)-Inη (T2))/(T1-T2) | (Inη (T2)-Inη (T3))/(T2-T3) | (Inη (T0)-Inη (T1))/(T0-T1) | (Inη (T2)-Inη (T3))/(T2-T3)-(Inη (T1)-Inη (T2))/(T1-T2) | (Inη (T0)-Inη (T1))/(T0-T1)-(Inη (T1)-Inη (T2))/(T1-T2) | Maximum endothermic peak temperature of toner (° C.) | a/b | c/d | Resin particle dispersion |
|---|---|---|---|---|---|---|---|---|---|
| A1 | −0.215 | −0.090 | −0.110 | 0.125 | 0.105 | 85 | 5.0 | 2.9 | (3) |
| A2 | −0.168 | −0.080 | −0.085 | 0.088 | 0.083 | 85 | 5.1 | 2.5 | (2) |
| A3 | −0.143 | −0.100 | −0.078 | 0.043 | 0.065 | 85 | 49 | 2.6 | (1) |
| A4 | −0.213 | −0.090 | −0.106 | 0.123 | 0.107 | 85 | 5.0 | 2.8 | (3) |
| A5 | −0.214 | −0.100 | −0.110 | 0.114 | 0.104 | 85 | 5.1 | 2.4 | (3) |
| A6 | −0.154 | −0.135 | −0.077 | 0.019 | 0.077 | 70 | 5.1 | 2.6 | (1) |
| A7 | −0.153 | −0.133 | −0.080 | 0.020 | 0.073 | 100 | 4.9 | 2.8 | (1) |
| A8 | −0.155 | −0.141 | −0.083 | 0.014 | 0.072 | 63 | 5.0 | 2.5 | (1) |
| A9 | −0.156 | −0.136 | −0.079 | 0.020 | 0.077 | 102 | 5.1 | 2.9 | (1) |
| A10 | −0.152 | −0.141 | −0.073 | 0.011 | 0.079 | 85 | 1.5 | 1.3 | (1) |
| A11 | −0.153 | −0.142 | −0.071 | 0.011 | 0.082 | 85 | 7.2 | 3.5 | (1) |
| A12 | −0.155 | −0.135 | −0.075 | 0.020 | 0.080 | 85 | 8.5 | 4.5 | (1) |
| A13 | −0.154 | −0.134 | −0.078 | 0.020 | 0.076 | 85 | 0.7 | 0.6 | (1) |
| B1 | −0.129 | −0.090 | −0.068 | 0.039 | 0.061 | 85 | 5.3 | 2.9 | (5) |
| B2 | −0.215 | −0.155 | −0.113 | 0.060 | 0.102 | 85 | 5.3 | 2.9 | (3) |
| B3 | −0.180 | −0.186 | −0.109 | −0.006 | 0.071 | 85 | 5.3 | 2.9 | (4) |

| | | | | | Toner production conditions | | | |
|---|---|---|---|---|---|---|---|---|
| | First release agent particle dispersion | | Second release agent particle dispersion | | Amount of flocculant | Coalescence temperature | Holding temperature | Holding time |
| Toner | Type | Parts | Type | Parts | (parts) | (° C.) | (° C.) | (hours) |
| A1 | (2) | 12 | (3) | 24 | 2.1 | 91 | 85 | 1 |
| A2 | (2) | 12 | (3) | 24 | 2.1 | 92 | 85 | 1 |
| A3 | (2) | 12 | (3) | 24 | 2.1 | 93 | 85 | 1 |
| A4 | (2) | 12 | (3) | 24 | 1.9 | 92 | 85 | 1 |
| A5 | (2) | 12 | (3) | 24 | 1.7 | 91 | 85 | 1 |
| A6 | (1) | 12 | (2) | 24 | 1.7 | 77 | 70 | 1 |
| A7 | (3) | 12 | (4) | 24 | 1.7 | 108 | 95 | 1 |
| A8 | (1) | 28.8 | (2) | 7.2 | 1.7 | 70 | 65 | 1 |
| A9 | (3) | 7.2 | (4) | 28.8 | 1.7 | 108 | 95 | 1 |
| A10 | (2) | 12 | (3) | 24 | 1.7 | 91 | 85 | 0.5 |
| A11 | (2) | 12 | (3) | 24 | 1.7 | 92 | 85 | 2 |
| A12 | (2) | 12 | (3) | 24 | 1.7 | 93 | 85 | 3 |
| A13 | (2) | 12 | (3) | 24 | 1.7 | 92 | 85 | 0.25 |
| B1 | (2) | 12 | (3) | 24 | 2.1 | 91 | 85 | 1 |
| B2 | (2) | 12 | (3) | 24 | 1.5 | 93 | 85 | 1 |
| B3 | (2) | 12 | (3) | 24 | 2.1 | 93 | 85 | 1 |

The ratio "a/b" in Table 1 is the "ratio of the number "a" of release agent domains with an aspect ratio of 5 or more to the number "b" of release agent domains with an aspect ratio of less than 5," and the ratio "c/d" is the "ratio of the total cross-sectional area "c" of the release agent domains with an aspect ratio of 5 or more to the total cross-sectional area "d" of the release agent domains with an aspect ratio of less than 5."

(Evaluation)

—Formation of Low-Area Coverage Image in High-Temperature Environment

The electrophotographic copiers in the Examples and Comparative Examples are used to print an image with an area coverage of 1% on 5,000 plain paper sheets (A4 paper P manufactured by Fuji Xerox Co., Ltd.) in a high-temperature environment (30° C., 90% RH). Then a solid image with an area coverage of 100% (Cin: 100%) is outputted on 5 embossed paper sheets (product name: LEATHAC 66 (basis weight: 151 g/m$^2$) manufactured by Fuji Xerox Co., Ltd., recording medium with surface irregularities).

The second transfer bias for image formation is shown below. A processing speed of 121 mm/s (thick paper mode) is used, and the pressure applied between the intermediate transfer body and the contact portion-forming member (i.e., transfer nip pressure) is controlled to 112 N by the pressure changing mechanism.

—Conditions for Second Transfer Bias—

Type: superimposed voltage with an AC voltage superimposed on a DC voltage

Waveform of AC voltage: waveform shown in FIG. 2

Peak-to-peak value Vpp of AC voltage: value shown in any of Tables 2 to 4 [kV]

Frequency of AC voltage: value shown in any of Tables 2 to 4 [kHz]

Duty ratio D of AC voltage: value shown in any of Tables 2 to 4 [%]

DC voltage Voff: value shown in any of Tables 2 to 4 [kV]

<Evaluation of Gradation Pattern Corresponding to Surface Irregularities of Recording Medium>

The image on the last embossed paper sheet outputted in the image formation described above is visually checked to evaluate the degree of the occurrence of a gradation pattern according to the following criteria.

A: No gradation pattern is found.

B: A gradation pattern is found, but the image is printed even on recesses portions of the embossed paper sheet.

C: A gradation pattern is found, and white patches occur in recessed portions of the embossed paper sheet (however, the number of white patches in the embossed paper sheet is less than 5).

D: The number of white patches in recessed portions of the embossed paper sheet is 5 or more.

TABLE 2

| | | | Intermediate transfer belt | | Second transfer bias | | | | | Evaluation of gradation pattern |
|---|---|---|---|---|---|---|---|---|---|---|
| | | | | | | AC voltage | | | DC | |
| | | Developer | Type | Elastic layer | Type | Vpp [kV] | Frequency [kHz] | Duty ratio D [%] | voltage voff [kV] | |
| Example | 1 | A1 | C1 | Yes | Superimposed voltage | 1 | 2 | 15 | −2 | B |
| | 2 | A2 | | | | 1 | 2 | 15 | −2 | A |
| | 3 | A3 | | | | 1 | 2 | 15 | −2 | A |
| | 4 | A4 | | | | 1 | 2 | 15 | −2 | B |
| | 5 | A5 | | | | 1 | 2 | 15 | −2 | B |
| | 6 | A6 | | | | 1 | 2 | 15 | −2 | A |
| | 7 | A7 | | | | 1 | 2 | 15 | −2 | A |
| | 8 | A8 | | | | 1 | 2 | 15 | −2 | A |
| | 9 | A9 | | | | 1 | 2 | 15 | −2 | A |
| | 10 | A10 | | | | 1 | 2 | 15 | −2 | A |
| | 11 | A11 | | | | 1 | 2 | 15 | −2 | A |
| | 12 | A12 | | | | 1 | 2 | 15 | −2 | A |
| | 13 | A13 | | | | 1 | 2 | 15 | −2 | A |
| Comparative Example | 1 | B1 | | | | 1 | 2 | 15 | −2 | C |
| | 2 | B2 | | | | 1 | 2 | 15 | −2 | D |
| | 3 | B3 | | | | 1 | 2 | 15 | −2 | C |

TABLE 3

| | | | Intermediate transfer belt | | Second transfer bias | | | | | Evaluation of gradation pattern |
|---|---|---|---|---|---|---|---|---|---|---|
| | | | | | | AC voltage | | | DC | |
| | | Developer | Type | Elastic layer | Type | Vpp [kV] | Frequency [kHz] | Duty ratio D [%] | voltage voff [kV] | |
| Example | 14 | A1 | C2 | No | Superimposed voltage | 1 | 2 | 15 | −2 | B |
| | 15 | A2 | | | | 1 | 2 | 15 | −2 | A |
| | 16 | A3 | | | | 1 | 2 | 15 | −2 | A |
| | 17 | A4 | | | | 1 | 2 | 15 | −2 | B |
| | 18 | A5 | | | | 1 | 2 | 15 | −2 | B |
| | 19 | A6 | | | | 1 | 2 | 15 | −2 | A |
| | 20 | A7 | | | | 1 | 2 | 15 | −2 | A |
| | 21 | A8 | | | | 1 | 2 | 15 | −2 | A |
| | 22 | A9 | | | | 1 | 2 | 15 | −2 | A |
| | 23 | A10 | | | | 1 | 2 | 15 | −2 | A |
| | 24 | A11 | | | | 1 | 2 | 15 | −2 | A |
| | 25 | A12 | | | | 1 | 2 | 15 | −2 | A |
| | 26 | A13 | | | | 1 | 2 | 15 | −2 | A |

TABLE 3-continued

| | | Developer | Intermediate transfer belt Type | Intermediate transfer belt Elastic layer | Second transfer bias Type | Second transfer bias AC voltage Vpp [kV] | Second transfer bias AC voltage Frequency [kHz] | Second transfer bias AC voltage Duty ratio D [%] | Second transfer bias DC voltage voff [kV] | Evaluation of gradation pattern |
|---|---|---|---|---|---|---|---|---|---|---|
| Comparative Example | 4 | B1 | | | | 1 | 2 | 15 | −2 | C |
| | 5 | B2 | | | | 1 | 2 | 15 | −2 | D |
| | 6 | B3 | | | | 1 | 2 | 15 | −2 | C |

TABLE 4

| | | Developer | Intermediate transfer belt Type | Intermediate transfer belt Elastic layer | Second transfer bias Type | Second transfer bias AC voltage Vpp [kV] | Second transfer bias AC voltage Frequency [kHz] | Second transfer bias AC voltage Duty ratio D [%] | Second transfer bias DC voltage voff [kV] | Evaluation of gradation pattern |
|---|---|---|---|---|---|---|---|---|---|---|
| Example | 27 | A2 | C1 | Yes | Superimposed voltage | 1 | 2 | 45 | −2 | B |
| | 28 | A2 | | | | 1 | 2 | 40 | −2 | B |
| | 29 | A2 | | | | 1 | 2 | 10 | −2 | A |
| | 30 | A2 | | | | 1.5 | 2 | 15 | −2 | A |
| | 31 | A2 | | | | 1 | 2 | 15 | −2 | A |
| | 32 | A2 | | | | 1 | 2 | 15 | −1 | B |

As can be seen from Tables 2 and 3, in each of the image forming apparatuses in the Examples, the toner used meets the following requirements: $(\ln \eta(T1)-\ln \eta(T2))/(T1-T2)$ is −0.14 or less; $(\ln \eta(T2)-\ln \eta(T3))/(T2-T3)$ is −0.15 or more; and $(\ln \eta(T2)-\ln \eta(T3))/(T2-T3)$ is larger than $(\ln \eta(T1)-\ln \eta(T2))/(T1-T2)$. With the image forming apparatuses in the Examples, the occurrence of a gradation pattern corresponding to the surface irregularities of the embossed paper sheet is more effectively prevented than with the image forming apparatuses in the Comparative Examples that do not meet at least one of the requirements.

As can be seen from Table 4, by using a second transfer bias including a superimposed voltage composed of an AC voltage with a duty ratio D of less than 50% and a DC voltage with negative polarity, the occurrence of the gradation pattern corresponding to the surface irregularities of the embossed paper sheet is prevented even when the conditions for the second transfer bias are changed.

(Developers A101 to A113 and B101 to B103)

—Preparation of Amorphous Polyester Resin Particle Dispersions—

<Production of Resin Particle Dispersion (101)>

A dry three-neck flask is charged with 60 parts of dimethyl terephthalate, 74 parts of dimethyl fumarate, 30 parts of dodecenyl succinic acid anhydride, 22 parts of trimellitic acid, 138 parts of propylene glycol, and 0.3 parts of dibutyl tin oxide. The mixture is allowed to react in a nitrogen atmosphere at 185° C. for 3 hours while water generated by the reaction is removed from the system to the outside. Then, while the pressure of the system is gradually reduced, the temperature is increased to 240° C. The reaction is allowed to further proceed for 4 hours, and the mixture is cooled. An amorphous polyester resin (101) with a weight average molecular weight of 39,000 is thereby produced.

Next, 200 parts of the amorphous polyester resin (101) with insoluble components removed, 100 parts of methyl ethyl ketone, 35 parts of isopropyl alcohol, and 7.0 parts of a 10 mass % ammonia water solution are placed in a separable flask, mixed sufficiently, and dissolved. Then ion exchanged water is added dropwise to the mixture at a feed rate of 8 g/minute using a feed pump while the mixture is heated to 40° C. and stirred. When the solution becomes uniformly cloudy, the feed rate of the ion exchange water is increased to 15 g/minute to perform phase inversion, and the dropwise addition is stopped when the total feed amount reaches 580 parts. Then the solvent is removed under reduced pressure to thereby obtain an amorphous polyester resin particle dispersion (101) (a resin particle dispersion (101)). The polyester resin particles obtained have a volume average particle diameter of 170 nm, and the solid content of the resin particles is 35%.

<Preparation of Resin Particle Dispersions (102) to (105)>

Resin particle dispersions (102) to (105) are obtained in the same manner as that for the resin particle dispersion (101) except that the conditions are changed to those shown in Table 5.

TABLE 5

| | Polymerization time of resin | Weight average molecular weight of polyester resin |
|---|---|---|
| Amorphous polyester resin particle dispersion (101) | 3 hours at 185° C. and 4 hours at 240° C. | 39,000 |
| Amorphous polyester resin particle dispersion (102) | 2.5 hours at 185° C. and 3.5 hours at 240° C. | 37,000 |
| Amorphous polyester resin particle dispersion (103) | 2 hours at 185° C. and 3 hours at 240° C. | 35,000 |
| Amorphous polyester resin particle dispersion (104) | 1.5 hours at 185° C. and 2.5 hours at 240° C. | 33,000 |

TABLE 5-continued

| | Polymerization time of resin | Weight average molecular weight of polyester resin |
|---|---|---|
| Amorphous polyester resin particle dispersion (105) | 4 hours at 185° C. and 5 hours at 240° C. | 43,000 |

<Production of toner A101>

Ion exchanged water: 400 parts

Amorphous polyester resin particle dispersion (101): 200 parts

Magenta coloring agent particle dispersion: 40 parts

Release agent particle dispersion (2): 12 parts

Release agent particle dispersion (3): 24 parts

The above components are placed in a reaction vessel equipped with a thermometer, a pH meter, and a stirrer and held at 30° C. and a stirring speed of 150 rpm for 30 minutes while the temperature of the mixture is controlled from the outside using a heating mantle.

While the mixture is dispersed using a homogenizer (ULTRA-TURRAX T50 manufactured by IKA Japan), an aqueous PAC solution prepared by dissolving 2.1 parts of aluminum polychloride (PAC manufactured by Oji Paper Co., Ltd.: 30% powder) in 100 parts of ion exchanged water is added to the mixture. Then the resulting mixture is heated to 50° C., and particle diameters are measured using COULTER MULTISIZER II (manufactured by Coulter: aperture diameter: 50 μm) to adjust the volume average particle diameter to 4.9 μm. Then 115 parts of the amorphous polyester resin particle dispersion (101) is additionally added to cause the resin particles to adhere to the surface of the aggregated particles (to form a shell structure).

Next, 20 parts of a 10 mass % aqueous NTA (nitrilotriacetic acid) metal salt solution (CHELEST 70 manufactured by Chelest) is added, and the pH of the mixture is adjusted to 9.0 using a 1N aqueous sodium hydroxide solution. Then the resulting mixture is heated to 91° C. at a heating rate of 0.05° C./minute and held at 91° C. for 3 hours to obtain a toner slurry. The toner slurry obtained is cooled to 85° C. and held for 1 hour. Then the slurry is cooled to 25° C., and a magenta toner is thereby obtained. The magenta toner is re-dispersed in ion exchanged water and filtrated. This procedure is repeated to wash the toner until the electric conductivity of the filtrate reaches 20 μS/cm or less, and the product is vacuum-dried in an oven at 40° C. for 5 hours to thereby obtain toner particles.

1.5 Parts of hydrophobic silica (RY50 manufactured by Nippon Aerosil Co., Ltd.) and 1.0 part of hydrophobic titanium oxide (T805 manufactured by Nippon Aerosil Co., Ltd.) are mixed with 100 parts of the obtained toner particles using a sample mill at 10,000 rpm for 30 seconds. Then the mixture is sieved using a vibrating sieve with a mesh size of 45 μm to prepare a toner A101. The toner A101 has a volume average particle diameter of 5.8 μm.

<Production of Developer A101>

8 Parts of the toner A101 and 92 parts of a carrier are mixed using a V blender to produce a developer A101 (an electrostatic image developer A101).

<Production of Developers A102 to A113, B101, and B102>

Magenta toners A102 to A113, B101, and B102 are obtained in the same manner as that for the toner A101 except that the resin particle dispersion used, the release agent particle dispersions used, the amount of the flocculant, coalescence temperature, holding temperature, and holding time are changed as shown in Table 6.

Electrostatic image developers A102 to A113, B101, and B102 are produced in the same manner as that for the developer A101 except that the toners obtained are used.

<Production of Developer B103>

A magenta toner B103 is obtained in the same manner as that for the toner A101 except that the resin particle dispersion used, the release agent particle dispersions used, the amount of the flocculant, coalescence temperature, holding temperature, and holding time are changed as shown in Table 6.

An electrostatic image developer B103 is produced in the same manner as that for the developer A101 except that the toner obtained is used.

TABLE 6

| Toner | (Inη (T1)-Inη (T2))/(T1-T2) | (Inη (T2)-Inη (T3))/(T2-T3) | (Inη (T0)-Inη (T1))/(T0-T1) | (Inη (T2)-Inη (T3))/(T2-T3)-(Inη (T1)-Inη (T2))/(T1-T2) | (Inη (T0)-Inη (T1))/(T0-T1)-(Inη (T1)-Inη (T2))/(T1-T2) | Maximum endothermic peak temperature of toner (° C.) | a/b | c/d | IR ratio (a) | IR ratio (b) |
|---|---|---|---|---|---|---|---|---|---|---|
| A101 | −0.220 | −0.110 | −0.100 | 0.110 | 0.120 | 85 | 5.2 | 2.7 | 0.30 | 0.16 |
| A102 | −0.163 | −0.070 | −0.080 | 0.093 | 0.083 | 85 | 4.9 | 2.3 | 0.31 | 0.15 |
| A103 | −0.141 | −0.100 | −0.065 | 0.041 | 0.076 | 85 | 4.8 | 2.7 | 0.29 | 0.17 |
| A104 | −0.222 | −0.080 | −0.111 | 0.142 | 0.111 | 85 | 5.2 | 2.7 | 0.33 | 0.16 |
| A105 | −0.211 | −0.110 | −0.101 | 0.101 | 0.110 | 85 | 5.0 | 2.5 | 0.34 | 0.17 |
| A106 | −0.156 | −0.131 | −0.075 | 0.025 | 0.081 | 70 | 4.9 | 2.4 | 0.30 | 0.16 |
| A107 | −0.154 | −0.135 | −0.072 | 0.019 | 0.082 | 100 | 4.7 | 2.9 | 0.29 | 0.15 |
| A108 | −0.155 | −0.139 | −0.079 | 0.016 | 0.076 | 85 | 1.6 | 1.4 | 0.33 | 0.17 |
| A109 | −0.154 | −0.141 | −0.077 | 0.013 | 0.077 | 85 | 7.1 | 3.3 | 0.29 | 0.18 |
| A110 | −0.151 | −0.136 | −0.072 | 0.015 | 0.079 | 63 | 5.2 | 2.9 | 0.27 | 0.16 |
| A111 | −0.153 | −0.140 | −0.081 | 0.013 | 0.072 | 102 | 5.1 | 2.5 | 0.34 | 0.17 |
| A112 | −0.152 | −0.133 | −0.080 | 0.019 | 0.072 | 85 | 8.6 | 4.6 | 0.33 | 0.16 |
| A113 | −0.151 | −0.133 | −0.071 | 0.018 | 0.080 | 85 | 0.8 | 0.5 | 0.31 | 0.15 |
| B101 | −0.127 | −0.110 | −0.055 | 0.017 | 0.072 | 85 | 5.0 | 2.7 | 0.34 | 0.16 |

TABLE 6-continued

| | | | | | | | | | | |
|---|---|---|---|---|---|---|---|---|---|---|
| B102 | −0.221 | −0.160 | −0.132 | 0.061 | 0.089 | 85 | 5.1 | 2.8 | 0.28 | 0.18 |
| B103 | −0.203 | −0.224 | −0.119 | −0.021 | 0.084 | 85 | 5.3 | 3.0 | 0.36 | 0.17 |

| | | | | | | Toner production conditions | | | |
|---|---|---|---|---|---|---|---|---|---|
| | Resin particle | First release agent particle dispersion | | Second release agent particle dispersion | | Amount of flocculant | Coalescence temperature | Holding temperature | Holding time |
| Toner | dispersion | Type | Parts | Type | Parts | (parts) | (° C.) | (° C.) | (hours) |
| A101 | (103) | (2) | 12 | (3) | 24 | 2.1 | 91 | 85 | 1 |
| A102 | (102) | (2) | 12 | (3) | 24 | 2.1 | 92 | 85 | 1 |
| A103 | (101) | (2) | 12 | (3) | 24 | 2.1 | 93 | 85 | 1 |
| A104 | (103) | (2) | 12 | (3) | 24 | 1.9 | 92 | 85 | 1 |
| A105 | (103) | (2) | 12 | (3) | 24 | 1.7 | 91 | 85 | 1 |
| A106 | (101) | (1) | 12 | (2) | 24 | 1.7 | 77 | 70 | 1 |
| A107 | (101) | (3) | 12 | (4) | 24 | 1.7 | 108 | 95 | 1 |
| A108 | (101) | (2) | 12 | (3) | 24 | 1.7 | 91 | 85 | 0.5 |
| A109 | (101) | (2) | 12 | (3) | 24 | 1.7 | 92 | 85 | 2 |
| A110 | (103) | (1) | 28.8 | (2) | 7.2 | 1.7 | 70 | 65 | 1 |
| A111 | (103) | (3) | 7.2 | (4) | 28.8 | 1.7 | 108 | 95 | 1 |
| A112 | (103) | (2) | 12 | (3) | 24 | 1.7 | 93 | 85 | 3 |
| A113 | (103) | (2) | 12 | (3) | 24 | 1.7 | 92 | 85 | 0.25 |
| B101 | (105) | (2) | 12 | (3) | 24 | 2.1 | 91 | 85 | 1 |
| B102 | (103) | (2) | 12 | (3) | 24 | 1.5 | 93 | 85 | 1 |
| B103 | (104) | (2) | 12 | (3) | 24 | 1.5 | 93 | 85 | 1 |

The ratios "a/b" and "c/d" in Table 6 are the same as those in Table 1. The "IR ratio (a)" is the "ratio of the absorbance of the toner particles in infrared absorption spectrum analysis at a wavenumber of 1,500 $cm^{-1}$ to the absorbance at a wavenumber of 720 $cm^{-1}$ (i.e., the absorbance at a wavenumber of 1,500 $cm^{-1}$/the absorbance at a wavenumber of 720 $cm^{-1}$)," and the "IR ratio (b)" is the "ratio of the absorbance of the toner particles in infrared absorption spectrum analysis at a wavenumber of 820 $cm^{-1}$ to the absorbance at a wavenumber of 720 $cm^{-1}$ (i.e., the absorbance at a wavenumber of 820 $cm^{-1}$/the absorbance at a wavenumber of 720 $cm^{-1}$)."

Examples 101 to 132 and Comparative Examples 101 to 106

A commercial electrophotographic copier (DOCU CENTRE COLOR 450 manufactured by Fuji Xerox Co., Ltd.), which is a second transfer-type image forming apparatus using an intermediate transfer belt, is prepared. One of the intermediate transfer belts shown in Tables 7 to 9 is placed in the electrophotographic copier, and the pressure changing mechanism shown in FIGS. 3 and 4 is placed in the copier. Then one of the developers shown in Tables 7 to 9 is placed in a developing device of the copier.

(Evaluation)

A low-area coverage image is formed in a high-temperature environment in the same manner as described above, and the evaluation of a gradation pattern is performed.

The second transfer bias for image formation is as follows.

—Conditions for Second Transfer Bias—

Type: superimposed voltage with an AC voltage superimposed on a DC voltage

Waveform of AC voltage: waveform shown in FIG. 2

Peak-to-peak value Vpp of AC voltage: value shown in any of Tables 7 to 9 [kV]

Frequency of AC voltage: value shown in any of Tables 7 to 9 [kHz]

Duty ratio D of AC voltage: value shown in any of Tables 7 to 9 [%]

DC voltage Voff: value shown in any of Tables 7 to 9 [kV]

TABLE 7

| | | | Intermediate transfer belt | | Second transfer bias | | | | | Evaluation of |
|---|---|---|---|---|---|---|---|---|---|---|
| | | | | | | AC voltage | | | DC | |
| | | Developer | Type | Elastic layer | Type | Vpp [kV] | Frequency [kHz] | Duty ratio D [%] | voltage voff [kV] | gradation pattern |
| Example | 101 | A101 | C1 | Yes | Superimposed voltage | 1 | 2 | 15 | −2 | B |
| | 102 | A102 | | | | 1 | 2 | 15 | −2 | A |
| | 103 | A103 | | | | 1 | 2 | 15 | −2 | A |
| | 104 | A104 | | | | 1 | 2 | 15 | −2 | B |
| | 105 | A105 | | | | 1 | 2 | 15 | −2 | B |
| | 106 | A106 | | | | 1 | 2 | 15 | −2 | A |
| | 107 | A107 | | | | 1 | 2 | 15 | −2 | A |
| | 108 | A108 | | | | 1 | 2 | 15 | −2 | A |
| | 109 | A109 | | | | 1 | 2 | 15 | −2 | A |
| | 110 | A110 | | | | 1 | 2 | 15 | −2 | A |
| | 111 | A111 | | | | 1 | 2 | 15 | −2 | A |
| | 112 | A112 | | | | 1 | 2 | 15 | −2 | A |
| | 113 | A113 | | | | 1 | 2 | 15 | −2 | A |

TABLE 7-continued

| | | | Intermediate transfer belt | | Second transfer bias | | | | | Evaluation of |
|---|---|---|---|---|---|---|---|---|---|---|
| | | | | | | AC voltage | | | DC | |
| | | Developer | Type | Elastic layer | Type | Vpp [kV] | Frequency [kHz] | Duty ratio D [%] | voltage voff [kV] | gradation pattern |
| Comparative Example | 101 | B101 | | | | 1 | 2 | 15 | −2 | C |
| | 102 | B102 | | | | 1 | 2 | 15 | −2 | D |
| | 103 | B103 | | | | 1 | 2 | 15 | −2 | C |

TABLE 8

| | | | Intermediate transfer belt | | Second transfer bias | | | | | Evaluation of |
|---|---|---|---|---|---|---|---|---|---|---|
| | | | | | | AC voltage | | | DC | |
| | | Developer | Type | Elastic layer | Type | Vpp [kV] | Frequency [kHz] | Duty ratio D [%] | voltage voff [kV] | gradation pattern |
| Example | 111 | A101 | C2 | No | Superimposed voltage | 1 | 2 | 15 | −2 | B |
| | 112 | A102 | | | | 1 | 2 | 15 | −2 | A |
| | 113 | A103 | | | | 1 | 2 | 15 | −2 | A |
| | 114 | A104 | | | | 1 | 2 | 15 | −2 | B |
| | 115 | A105 | | | | 1 | 2 | 15 | −2 | B |
| | 116 | A106 | | | | 1 | 2 | 15 | −2 | A |
| | 117 | A107 | | | | 1 | 2 | 15 | −2 | A |
| | 118 | A108 | | | | 1 | 2 | 15 | −2 | A |
| | 119 | A109 | | | | 1 | 2 | 15 | −2 | A |
| | 120 | A110 | | | | 1 | 2 | 15 | −2 | A |
| | 121 | A111 | | | | 1 | 2 | 15 | −2 | A |
| | 122 | A112 | | | | 1 | 2 | 15 | −2 | A |
| | 123 | A113 | | | | 1 | 2 | 15 | −2 | A |
| Comparative Example | 104 | B101 | | | | 1 | 2 | 15 | −2 | C |
| | 105 | B102 | | | | 1 | 2 | 15 | −2 | D |
| | 106 | B103 | | | | 1 | 2 | 15 | −2 | C |

TABLE 9

| | | | Intermediate transfer belt | | Second transfer bias | | | | | Evaluation of |
|---|---|---|---|---|---|---|---|---|---|---|
| | | | | | | AC voltage | | | DC | |
| | | Developer | Type | Elastic layer | Type | Vpp [kV] | Frequency [kHz] | Duty ratio D [%] | voltage voff [kV] | gradation pattern |
| Example | 127 | A102 | C1 | Yes | Superimposed voltage | 1 | 2 | 45 | −2 | B |
| | 128 | A102 | | | | 1 | 2 | 40 | −2 | B |
| | 129 | A102 | | | | 1 | 2 | 10 | −2 | A |
| | 130 | A102 | | | | 1.5 | 2 | 15 | −2 | A |
| | 131 | A102 | | | | 1 | 2 | 15 | −2 | A |
| | 132 | A102 | | | | 1 | 2 | 15 | −1 | B |

As can be seen from Tables 7 and 8, in each of the image forming apparatuses in the Examples, the toner used meets the following requirements: $(\ln \eta(T1)-\ln \eta(T2))/(T1-T2)$ is −0.14 or less; $(\ln \eta(T2)-\ln \eta(T3))/(T2-T3)$ is −0.15 or more; and $(\ln \eta(T2)-\ln \eta(T3))/(T2-T3)$ is larger than $(\ln \eta(T1)-\ln \eta(T2))/(T1-T2)$. With the image forming apparatuses in the Examples, the occurrence of a gradation pattern corresponding to the surface irregularities of the embossed paper sheet is more effectively prevented than with the image forming apparatuses in the Comparative Examples that do not meet at least one of the requirements.

As can be seen from Table 9, by using a second transfer bias including a superimposed voltage composed of an AC voltage with a duty ratio D of less than 50% and a DC voltage with negative polarity, the occurrence of the gradation pattern corresponding to the surface irregularities of the embossed paper sheet is prevented even when the conditions for the second transfer bias are changed.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

an image holding member;

a charging unit configured to charge a surface of the image holding member;

an electrostatic image forming unit configured to form an electrostatic image on the charged surface of the image holding member;

a developing unit that contains an electrostatic image developer including a toner having an external additive and is configured to develop the electrostatic image formed on the surface of the image holding member with the electrostatic image developer to thereby form a toner image;

a transfer unit configured to transfer the toner image formed on the surface of the image holding member onto a surface of a recording medium directly or through an intermediate transfer body; and a fixing unit configured to fix the toner image transferred onto the surface of the recording medium, wherein the transfer unit includes a contact portion-forming member configured to contact with the image holding member or the intermediate transfer body to form a contact portion and a transfer bias application unit configured to apply a transfer bias including a superimposed voltage to the contact portion, wherein the superimposed voltage has two peak values and is composed of an AC voltage and a DC voltage, the AC voltage having a duty ratio D of less than 50% on a peak value side opposite to a peak value that causes the toner in the contact portion to move from the image holding member or the intermediate transfer body toward the contact portion-forming member, the DC voltage causing the electric potential of the contact portion-forming member to be shifted to a side opposite to the charge polarity of the toner such that the absolute value of the electric potential of the contact portion-forming member is larger than the absolute value of the electric potential of the image holding member or the intermediate transfer body, and wherein the toner satisfies the following formulas:

$$(\ln \eta(T1)-\ln \eta(T2))/(T1-T2)\leq -0.14;$$

$$(\ln \eta(T2)-\ln \eta(T3))/(T2-T3)\geq -0.15; \text{ and}$$

$$(\ln \eta(T1)-\ln \eta(T2))/(T1-T2)<(\ln \eta(T2)-\ln \eta(T3))/(T2-T3),$$

where η(T1) is a viscosity of the toner at 60° C., η(T2) is a viscosity of the toner at 90° C., and η(T3) is a viscosity of the toner at 130° C.

2. The image forming apparatus according to claim 1, wherein, in the toner, (ln η(T0)−ln η(T1))/(T0−T1) is −0.12 or more, and (ln η(T0)−ln η(T1))/(T0−T1) is larger than (ln η(T1)−ln η(T2))/(T1−T2), where η(T0) is the viscosity of the toner at T0=40° C.

3. The image forming apparatus according to claim 1, wherein the toner satisfies the following formula:

$$(\ln \eta(T1)-\ln \eta(T2))/(T1-T2)\leq -0.16.$$

4. The image forming apparatus according to claim 1, wherein the toner satisfies the following formula:

$$(\ln \eta(T2)-\ln \eta(T3))/(T2-T3)<-0.13.$$

5. The image forming apparatus according to claim 1, wherein the toner contains a release agent, and wherein the toner satisfies the following formula:

$$1.0<a/b<8.0,$$

where a is a number of release agent domains with an aspect ratio of 5 or more in the toner, and b is a number of release agent domains with an aspect ratio of less than 5 in the toner.

6. The image forming apparatus according to claim 1, wherein the toner contains a release agent, and wherein the toner satisfies the following formula:

$$1.0<c/d<4.0,$$

where c is a total cross-sectional area of release agent domains with an aspect ratio of 5 or more in the toner, and d is a total cross-sectional area of release agent domains with an aspect ratio of less than 5 in the toner.

7. The image forming apparatus according to claim 1, wherein the toner has a maximum endothermic peak temperature within a range of 70° C. to 100° C.

8. The image forming apparatus according to claim 1, wherein the toner has a maximum endothermic peak temperature within a range of 75° C. to 95° C.

9. The image forming apparatus according to claim 1, wherein the toner contains a styrene-acrylic resin as a binder resin.

10. The image forming apparatus according to claim 1, wherein the toner contains an amorphous polyester resin as a binder resin.

11. The image forming apparatus according to claim 1, wherein a duty ratio D is 40% or less.

12. The image forming apparatus according to claim 1, wherein the transfer unit further includes a mechanism capable of changing a pressure acting on the contact portion.

13. The image forming apparatus according to claim 1, wherein the transfer unit is configured to transfer the toner image formed on the surface of the image holding member onto the surface of the recording medium through the intermediate transfer body.

14. The image forming apparatus according to claim 13, wherein the intermediate transfer body includes an elastic layer.

* * * * *